US010654500B2

(12) United States Patent
Schultz et al.

(10) Patent No.: US 10,654,500 B2
(45) Date of Patent: May 19, 2020

(54) ARRIVAL TIME AND LOCATION TARGETING SYSTEM AND METHOD

(71) Applicant: Westinghouse Air Brake Technologies Corporation, Wilmerding, PA (US)

(72) Inventors: Timothy Allen Schultz, Marion, IA (US); Scott A. Sollars, Marion, IA (US); Joseph W. Gorman, Springville, IA (US); Michael W. Steffen, II, Lee's Summit, MO (US); Frank J. Swiderski, Cedar Rapids, IA (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 0 days.

(21) Appl. No.: 15/176,362

(22) Filed: Jun. 8, 2016

(65) Prior Publication Data

US 2016/0362123 A1 Dec. 15, 2016

Related U.S. Application Data

(60) Provisional application No. 62/174,859, filed on Jun. 12, 2015.

(51) Int. Cl.
*B61L 25/02* (2006.01)
*B61L 27/00* (2006.01)
(Continued)

(52) U.S. Cl.
CPC ..... *B61L 25/021* (2013.01); *B61L 3/008* (2013.01); *B61L 15/0027* (2013.01);
(Continued)

(58) Field of Classification Search
CPC ..... B61L 25/021; B61L 25/025; B61L 3/008; B61L 13/00; B61L 15/0027; B61L 23/00;
(Continued)

(56) References Cited

U.S. PATENT DOCUMENTS 4,617,627 A * 10/1986 Yasunobu ..... B61L 3/008 246/182 B
5,487,516 A * 1/1996 Murata ..... B61L 27/0022 246/182 C (Continued)

*Primary Examiner* — Harry Y Oh
(74) *Attorney, Agent, or Firm* — Christopher R. Caroll; The Small Patent Law Group LLC

(57) ABSTRACT

An arrival time and location targeting system for a train, the system including at least one computer programmed or configured to: (a) receive at least one target location associated with a forward route of the train; (b) determine required time of arrival at the at least one target location based at least partially on the current location of a leading edge of the train; (c) determine an estimated time of arrival of the leading edge of the train at the at least one target location based at least partially on the current location of the leading edge of the train and the current speed of the train; and (d) based at least partially on the difference between the determined required time of arrival and the determined estimated time of arrival, generate a target speed of the train. A computer-implemented arrival time and location targeting method is also provided.

16 Claims, 13 Drawing Sheets

(51) Int. Cl.
*B61L 3/00* (2006.01)
*B61L 15/00* (2006.01)

(52) U.S. Cl.
CPC ..... *B61L 25/025* (2013.01); *B61L 27/0022* (2013.01); *B61L 27/0038* (2013.01)

(58) Field of Classification Search
CPC .. B61L 27/0022; B61L 27/0038; B61L 29/28; B61L 29/30; B61L 29/32; B61L 2205/00; B61L 2205/02; B61L 2205/04
See application file for complete search history.

(56) References Cited

U.S. PATENT DOCUMENTS 6,304,801 B1 * 10/2001 Doner ..... B61L 27/0016 246/182 R
6,546,371 B1 * 4/2003 Doner ..... B61L 27/0016 705/7.26
6,572,056 B2 6/2003 Berry et al.
6,873,962 B1 * 3/2005 Doner ..... B61L 27/0016 705/7.22
7,575,202 B2 8/2009 Sharkey et al.
7,832,691 B2 11/2010 Reibeling et al.
8,214,091 B2 7/2012 Kernwein
8,370,006 B2 * 2/2013 Kumar ..... B61L 3/006 701/19
8,833,703 B2 9/2014 Steffen, II et al.
8,924,066 B2 12/2014 Fries
9,026,360 B2 5/2015 Fries et al.
9,126,609 B2 9/2015 Steffen, II et al.
9,150,229 B2 10/2015 Steffen et al.
2008/0201028 A1 * 8/2008 Brooks ..... B61L 3/006 701/20
2009/0115633 A1 5/2009 Lawry et al.
2009/0184214 A1 7/2009 Reibeling et al.
2010/0262321 A1 * 10/2010 Daum ..... B61L 3/006 701/20
2012/0245770 A1 * 9/2012 Yamamoto ..... B61L 3/008 701/20
2013/0171590 A1 * 7/2013 Kumar ..... B61L 3/006 434/62
2013/0325224 A1 * 12/2013 Yamamoto ..... B61L 27/0016 701/20
2014/0191090 A1 7/2014 Busse et al.
2014/0346284 A1 11/2014 Fries et al.
2017/0355388 A1 * 12/2017 Schultz ..... B61L 25/025

* cited by examiner

ARRIVAL TIME AND LOCATION TARGETING SYSTEM AND METHOD

CROSS REFERENCE TO RELATED APPLICATIONS

This application claims the benefit of priority from U.S. Provisional Patent Application No. 62/174,859, entitled "Arrival Time and Location Targeting System and Method" and filed Jun. 12, 2015, which is incorporated herein by reference in its entirety.

BACKGROUND OF THE INVENTION

Field of the Invention

This invention relates generally to vehicle systems and control processes, such as railway systems including trains travelling in a track or rail network, and in particular to an arrival time and location targeting system and method that may be used in connection with navigation in railway networks, such as in connection with railway networks that include target locations (e.g., a crossing, a safety target, a track section, a track location, a specified location, a restricted speed location, a circuit, a restricted noise location, and the like).

Description of Related Art

Vehicle systems and networks exist throughout the world, and, at any point in time, a multitude of vehicles, such as cars, trucks, buses, trains, and the like, are travelling throughout the system and network. With specific reference to trains travelling in a track network, the locomotives of such trains are typically equipped with or operated using train control, communication, and management systems (e.g., positive train control (PTC) systems), such as the I-ETMS® of Wabtec Corp. In order to effectively manage all of the trains, navigation and enforcement systems and processes are implemented, both at the train level and the central dispatch level.

With respect to existing PTC systems and processes, targeting (i.e., prediction or determination of a future parameter) is based upon enforcing track speeds, restricted speeds, or stop targets. In particular, it is recognized that the targeting process of the on-board system is based on speed and braking predictor curves, and specific speed limits defined at single locations or location ranges. This does not lend itself to the concept of targeting based on when a train can arrive at a specific location in time. For example, with wireless crossing activation applications, the need for speed enforcement is secondary to the need for time enforcement. Due to the nature of a crossing, a certain amount of warning time must be realized before the train can safely traverse the crossing (or other target location). The existing targeting methodology does not account for changes in acceleration or deceleration, and does not enforce the warning and preemption times for the crossing. Instead, the methodology only enforces a set or specified speed.

For at least these reasons, there is a need in the art for an improved arrival time and targeting systems and methods. By creating and enforcing time-based targets, the train is permitted to change speeds as long as a target time or location is met, and the train will be warned or enforced to stop if it violates a specified target time or location.

SUMMARY OF THE INVENTION

Generally, provided are an improved arrival time and location targeting system and computer-implemented method, preferably for use in connection with trains travelling in a track network. Preferably, provided are an arrival time and targeting system and computer-implemented method that generate time-based targets for specified target locations. Preferably, provided are an arrival time and location targeting system and computer-implemented method that generate a variable speed target at the desired target location, and base that speed on an iterative algorithm that is implemented as the vehicle moves forward. Preferably, provided are an arrival time and location targeting system and computer-implemented method that automatically warn and enforce when an unsafe early arrival condition is predicted. Preferably, provided are an arrival time and location targeting system and computer-implemented method that generate advisory prompts or alarms to warn an operator to decelerate or accelerate to meet the required time of arrival at the target location.

According to one preferred and non-limiting embodiment or aspect, provided is an arrival time and location targeting system for a train comprising at least one locomotive or control car, the system comprising at least one computer programmed or configured to: (a) receive at least one target location associated with a forward route of the train; (b) determine required time of arrival at the at least one target location based at least partially on the current location of a leading edge of the train; (c) determine an estimated time of arrival of the leading edge of the train at the at least one target location based at least partially on the current location of the leading edge of the train and the current speed of the train; and (d) based at least partially on the difference between the determined required time of arrival and the determined estimated time of arrival, generate a target speed of the train.

In one preferred and non-limiting embodiment or aspect, steps (a)-(d) are repeated on at least one of the following bases: periodically, on a set interval, at least partially based upon a speed of the train, at least partially based upon the location of at least a portion of the train, at least partially based upon the location of a leading edge of the train, at least partially based upon at least one braking prediction process, or any combination thereof.

In one preferred and non-limiting embodiment or aspect, at least partially based upon the difference between the determined required time of arrival and the determined estimated time of arrival, the at least one computer is programmed or configured to implement or cause the implementation of at least one braking enforcement action.

In one preferred and non-limiting embodiment or aspect, at least partially based upon the current speed of the train, the at least one computer is programmed or configured to implement or cause the implementation of at least one braking enforcement action.

In one preferred and non-limiting embodiment or aspect, at least partially based upon the current location of the leading edge of the train, the at least one computer is programmed or configured to implement or cause the implementation of at least one braking enforcement action.

In one preferred and non-limiting embodiment or aspect, the target speed of the train speed is less than the current speed of the train.

In one preferred and non-limiting embodiment or aspect, at least partially based upon the difference between the target speed of the train and the current speed of the train, the at least one computer is programmed or configured to implement or cause the implementation of at least one braking enforcement action.

In one preferred and non-limiting embodiment or aspect, the target speed of the train is greater than the current speed of the train.

In one preferred and non-limiting embodiment or aspect, the target speed of the train is substantially the same as the current speed of the train.

In one preferred and non-limiting embodiment or aspect, at least one of the following is displayed to at least one user on a visual display device in the at least one locomotive or control car: the estimated time of arrival, the required time of arrival, the current speed of the train, the target speed of the train, the at least one target location, the current location of the leading edge of the train, braking data, alarm data, train data, track data, target location data, or any combination thereof.

In one preferred and non-limiting embodiment or aspect, the at least one target location is associated with at least one of the following: a crossing, a safety target, a track section, a track location, a specified location, a restricted speed location, a circuit, a restricted noise location, or any combination thereof.

In one preferred and non-limiting embodiment or aspect, at least partially based upon the difference between the determined required time of arrival and the determined estimated time of arrival, the at least one computer is programmed or configured to communicate or cause the communication of specified data to at least one of the following: an on-board computer, a remote server, a wayside device, a device associated with a crossing, a signal device, a cellular device, a specified entity, or any combination thereof.

In one preferred and non-limiting embodiment or aspect, at least partially based upon the current speed of the train, the at least one computer is programmed or configured to communicate or cause the communication of specified data to at least one of the following: a remote server, a wayside device, a device associated with a crossing, a signal device, a cellular device, a specified entity, or any combination thereof.

In one preferred and non-limiting embodiment or aspect, at least partially based upon the current location of the leading edge of the train, the at least one computer is programmed or configured to communicate or cause the communication of specified data to at least one of the following: an on-board computer, a remote server, a wayside device, a device associated with a crossing, a signal device, a cellular device, a specified entity, or any combination thereof.

In one preferred and non-limiting embodiment or aspect, the at least one target location is stored in at least one database, and the at least one computer is in direct or indirect communication with the at least one database.

In one preferred and non-limiting embodiment or aspect, the at least one database comprises the track database in a positive train control system.

In one preferred and non-limiting embodiment or aspect, for a first point, the estimated time of arrival is determined based at least partially on the current location of the leading edge of train, the current speed of the train, and the time difference between estimated time of arrival and current time.

In one preferred and non-limiting embodiment or aspect, for a second, future point, the required time of arrival is determined based at least partially on the at least one target location, a predicted location of the leading edge of the train, a predicted speed of the train, and the time difference between the required time of arrival and a predicted time.

In one preferred and non-limiting embodiment or aspect, the predicted location of the leading edge of the train is determined at least partially based on the current location of the leading edge of the train, the difference in speed between the current speed of the train and the predicted speed of the train, and the time difference between the current time and the predicted time.

In one preferred and non-limiting embodiment or aspect, the predicted time is determined based at least partially on at least one of a nominal acceleration constant for the train and a nominal deceleration constant for the train.

In one preferred and non-limiting embodiment or aspect, the target speed of the time comprises determining at least one of a target acceleration of the train and a target deceleration of the train.

According to one preferred and non-limiting embodiment or aspect, provided is a computer-implemented arrival time and location targeting method for a train comprising at least one locomotive or control car, the method comprising: (a) receiving at least one target location associated with a forward route of the train; (b) determining a required time of arrival at the at least one target location based at least partially on the current location of a leading edge of the train; (c) determining an estimated time of arrival of the leading edge of the train at the at least one target location based at least partially on the current location of the leading edge of the train and the current speed of the train; and (d) based at least partially on the difference between the determined required time of arrival and the determined estimated time of arrival, generating a target speed of the train.

According to one preferred and non-limiting embodiment or aspect, provided is an apparatus for arrival time and location targeting for a train comprising at least one locomotive or control car, the apparatus comprising at least one non-transitory computer-readable medium having program instructions stored thereon that, when executed by at least one processor, cause the at least one processor to: (a) receive at least one target location associated with a forward route of the train; (b) determine a required time of arrival at the at least one target location based at least partially on the current location of a leading edge of the train; (c) determine an estimated time of arrival of the leading edge of the train at the at least one target location based at least partially on the current location of the leading edge of the train and the current speed of the train; and (d) based at least partially on the difference between the determined required time of arrival and the determined estimated time of arrival, generate a target speed of the train.

Other preferred and non-limiting embodiment or aspects of the present invention will be set forth in the following numbered clauses:

Clause 1. An arrival time and location targeting system for a train comprising at least one locomotive or control car, the system comprising at least one computer programmed or configured to: (a) receive at least one target location associated with a forward route of the train; (b) determine required time of arrival at the at least one target location based at least partially on the current location of a leading edge of the train; (c) determine an estimated time of arrival of the leading edge of the train at the at least one target location based at least partially on the current location of the leading edge of the train and the current speed of the train; and (d) based at least partially on the difference between the determined required time of arrival and the determined estimated time of arrival, generate a target speed of the train.

Clause 2. The arrival time and location targeting system of clause 1, wherein steps (a)-(d) are repeated on at least one of the following bases: periodically, on a set interval, at least partially based upon a speed of the train, at least partially based upon the location of at least a portion of the train, at least partially based upon the location of a leading edge of the train, at least partially based upon at least one braking prediction process, or any combination thereof.

Clause 3. The arrival time and location targeting system of clause 1 or, wherein at least partially based upon the difference between the determined required time of arrival and the determined estimated time of arrival, the at least one computer is programmed or configured to implement or cause the implementation of at least one braking enforcement action.

Clause 4. The arrival time and location targeting system of any of clauses 1-3, wherein at least partially based upon the current speed of the train, the at least one computer is programmed or configured to implement or cause the implementation of at least one braking enforcement action.

Clause 5. The arrival time and location targeting system of any of clauses 1-4, wherein at least partially based upon the current location of the leading edge of the train, the at least one computer is programmed or configured to implement or cause the implementation of at least one braking enforcement action.

Clause 6. The arrival time and location targeting system of any of clauses 1-5, wherein the target speed of the train speed is less than the current speed of the train.

Clause 7. The arrival time and location targeting system of any of clauses 1-6, wherein at least partially based upon the difference between the target speed of the train and the current speed of the train, the at least one computer is programmed or configured to implement or cause the implementation of at least one braking enforcement action.

Clause 8. The arrival time and location targeting system of any of clauses 1-7, wherein the target speed of the train is greater than the current speed of the train.

Clause 9. The arrival time and location targeting system of any of clauses 1-8, wherein the target speed of the train is substantially the same as the current speed of the train.

Clause 10. The arrival time and location targeting system of any of clauses 1-9, wherein at least one of the following is displayed to at least one user on a visual display device in the at least one locomotive or control car: the estimated time of arrival, the required time of arrival, the current speed of the train, the target speed of the train, the at least one target location, the current location of the leading edge of the train, braking data, alarm data, train data, track data, target location data, or any combination thereof.

Clause 11. The arrival time and location targeting system of any of clauses 1-10, wherein the at least one target location is associated with at least one of the following: a crossing, a safety target, a track section, a track location, a specified location, a restricted speed location, a circuit, a restricted noise location, or any combination thereof.

Clause 12. The arrival time and location targeting system of any of clauses 1-11, wherein at least partially based upon the difference between the determined required time of arrival and the determined estimated time of arrival, the at least one computer is programmed or configured to communicate or cause the communication of specified data to at least one of the following: an on-board computer, a remote server, a wayside device, a device associated with a crossing, a signal device, a cellular device, a specified entity, or any combination thereof.

Clause 13. The arrival time and location targeting system of any of clauses 1-12, wherein at least partially based upon the current speed of the train, the at least one computer is programmed or configured to communicate or cause the communication of specified data to at least one of the following: a remote server, a wayside device, a device associated with a crossing, a signal device, a cellular device, a specified entity, or any combination thereof.

Clause 14. The arrival time and location targeting system of any of clauses 1-13, wherein at least partially based upon the current location of the leading edge of the train, the at least one computer is programmed or configured to communicate or cause the communication of specified data to at least one of the following: an on-board computer, a remote server, a wayside device, a device associated with a crossing, a signal device, a cellular device, a specified entity, or any combination thereof.

Clause 15. The arrival time and location targeting system of any of clauses 1-14, wherein the at least one target location is stored in at least one database, and the at least one computer is in direct or indirect communication with the at least one database.

Clause 16. The arrival time and location targeting system of any of clauses 1-15, wherein the at least one database comprises the track database in a positive train control system.

Clause 17. The arrival time and location targeting system of any of clauses 1-16, wherein, for a first point, the estimated time of arrival is determined based at least partially on the current location of the leading edge of train, the current speed of the train, and the time difference between estimated time of arrival and current time.

Clause 18. The arrival time and location targeting system of any of clauses 1-17, wherein, for a second, future point, the required time of arrival is determined based at least partially on the at least one target location, a predicted location of the leading edge of the train, a predicted speed of the train, and the time difference between the required time of arrival and a predicted time.

Clause 19. The arrival time and location targeting system of clauses 1-18, wherein the predicted location of the leading edge of the train is determined at least partially based on the current location of the leading edge of the train, the difference in speed between the current speed of the train and the predicted speed of the train, and the time difference between the current time and the predicted time.

Clause 20. The arrival time and location targeting system of any of clauses 1-19, wherein the predicted time is determined based at least partially on at least one of a nominal acceleration constant for the train and a nominal deceleration constant for the train.

Clause 21. The arrival time and location targeting system of any of clauses 1-20, wherein the target speed of the time comprises determining at least one of a target acceleration of the train and a target deceleration of the train.

Clause 22. A computer-implemented arrival time and location targeting method for a train comprising at least one locomotive or control car, the method comprising: (a) receiving at least one target location associated with a forward route of the train; (b) determining a required time of arrival at the at least one target location based at least partially on the current location of a leading edge of the train; (c) determining an estimated time of arrival of the leading edge of the train at the at least one target location based at least partially on the current location of the leading edge of the train and the current speed of the train; and (d) based at least partially on the difference between the determined required time of arrival and the determined estimated time of arrival, generating a target speed of the train.

Clause 23. An apparatus for arrival time and location targeting for a train comprising at least one locomotive or control car, the apparatus comprising at least one non-transitory computer-readable medium having program instructions stored thereon that, when executed by at least one processor, cause the at least one processor to: (a) receive at least one target location associated with a forward route of the train; (b) determine a required time of arrival at the at least one target location based at least partially on the current location of a leading edge of the train; (c) determine an estimated time of arrival of the leading edge of the train at the at least one target location based at least partially on the current location of the leading edge of the train and the current speed of the train; and (d) based at least partially on the difference between the determined required time of arrival and the determined estimated time of arrival, generate a target speed of the train.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and the include plural referents unless the context clearly dictates otherwise.

DETAILED DESCRIPTION OF THE PREFERRED EMBODIMENTS

Figure 1:
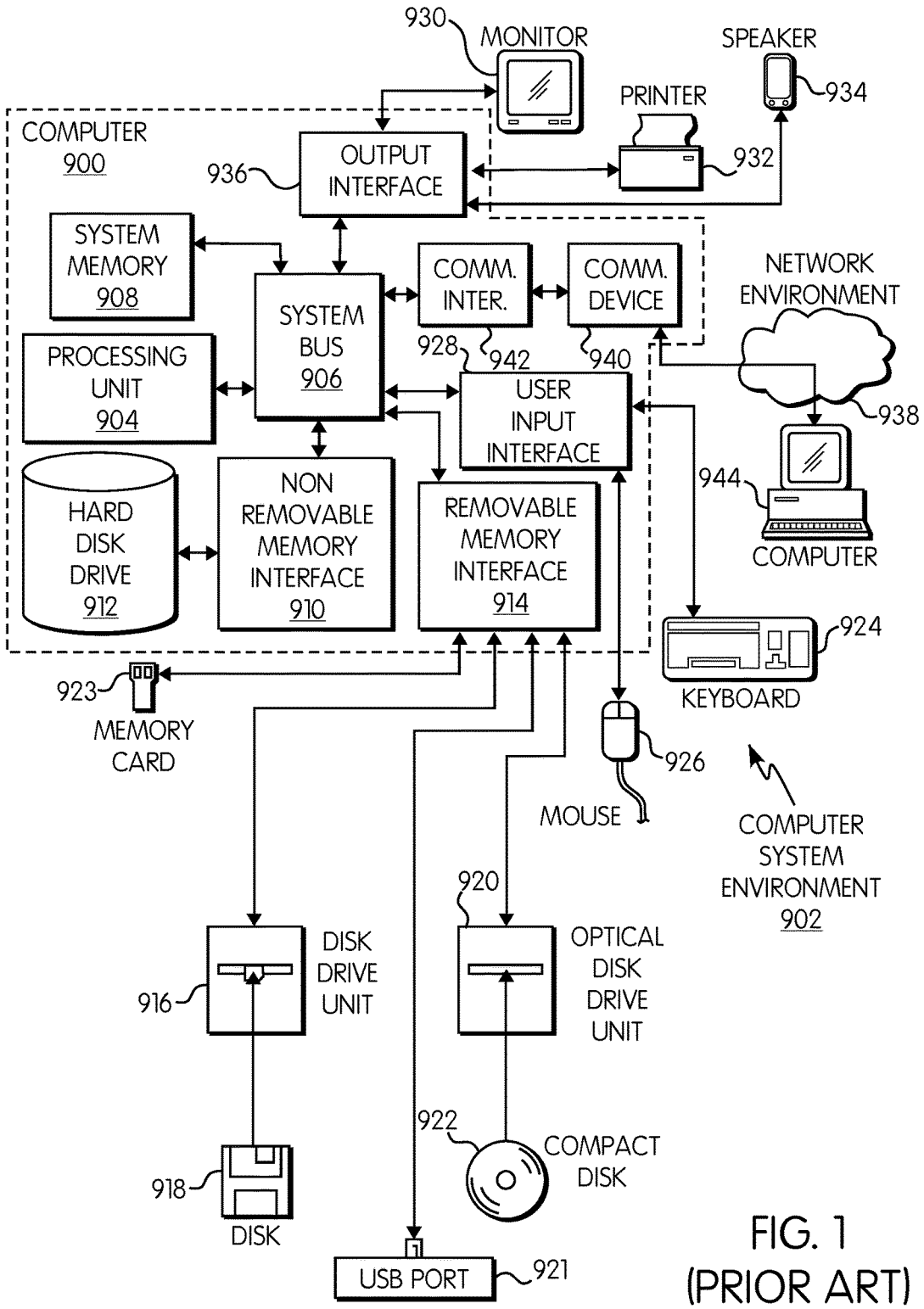
FIG. 1 (PRIOR ART)
FIG. 1 is a schematic view of a computer system and environment according to the prior art.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, and/or the like. It is to be noted that a "communication device" includes any device that facilitates communication (whether wirelessly or hard-wired (e.g., over the rails of a track, over a trainline extending between railcars of a train, and the like)) between two units, such as two locomotive units or control cars. In one preferred and non-limiting embodiment or aspect, the "communication device" is a radio transceiver programmed, configured, or adapted to wirelessly transmit and receive radio frequency signals and data over a radio signal communication path.

The arrival time and location targeting system and computer-implemented method described herein may be implemented in a variety of systems and vehicular networks; however, the systems and methods described herein are particularly useful in connection with a railway system and network. Accordingly, the presently-invented methods and systems can be implemented in various known train control and management systems, e.g., the I-ETMS® of Wabtec Corp. The systems and methods described herein are useful in connection with and/or at least partially implemented on one or more locomotives or control cars (L) that make up a train (TR). It should be noted that multiple locomotives or control cars (L) may be included in the train (TR) to facilitate the reduction of the train (TR) to match with passenger (or some other) demand or requirement. Further, the method and systems described herein can be used in connection with commuter trains, freight train, and/or other train arrangements and systems. Still further, the train (TR) may be separated into different configurations (e.g., other trains (TR)) and moved in either a first direction and/or a second direction. Any configuration or arrangement of locomotives, control cars, and/or railroad cars may be designated as a train and/or a consist.

In one preferred and non-limiting embodiment or aspect, the methods and systems described herein are used in connection with the locomotives or controls cars (L) that are positioned on each end of the train (TR), while in other preferred and non-limiting embodiments or aspects, the methods and systems described herein are used in connection with locomotives or control cars (L) that are positioned intermediately in the train (TR) (since these intermediate locomotives or control cars (L) may eventually become a controlling locomotive or control car (L) when the train (TR) is reconfigured). It is also noted that the methods and systems described herein may be used in connection with "electrical multiple unit" (EMU) or "diesel multiple unit" (DMU) configurations, where a locomotive does not technically exist, but multiple control cars would still be present. Still further, the train (TR) may include only one locomotive or control car (L) and/or some or no railroad cars. It should be noted that multiple locomotives or control cars (L) may be included in the train (TR) to facilitate the reduction of the train (TR) to match with passenger (or some other) demand or requirement. Further, the method and systems described herein can be used in connection with commuter trains, freight trains, push-pull train configurations, and/or other train arrangements and systems. Still further, the train (TR) may be separated into different configurations (e.g., other trains (TR)) and moved in either a first direction and/or a second direction. Any configuration or arrangement of locomotives, control cars, and/or railroad cars may be designated as a train and/or a consist. Still further, it is to be expressly understood that the presently-invented methods and systems described herein may be implemented on and/or used in connection with an auxiliary vehicle, such as an auxiliary railroad vehicle, a maintenance vehicle or machine, a road vehicle (e.g., truck, pick-up truck, car, or other machine), a vehicle equipped to ride on the rails of the track, and/or the like.

As shown in FIG. 1, and according to the prior art, personal computers 900, 944, in a computing system environment 902 may be provided or utilized, such as in connection with the on-board computer described below. This computing system environment 902 may include, but is not limited to, at least one computer 900 having certain components for appropriate operation, execution of code, and creation and communication of data. For example, the computer 900 includes a processing unit 904 (typically referred to as a central processing unit or CPU) that serves to execute computer-based instructions received in the appropriate data form and format. Further, this processing unit 904 may be in the form of multiple processors executing code in series, in parallel, or in any other manner for appropriate implementation of the computer-based instructions.

In order to facilitate appropriate data communication and processing information between the various components of the computer 900, a system bus 906 is utilized. The system bus 906 may be any of several types of bus structures, including a memory bus or memory controller, a peripheral bus, or a local bus using any of a variety of bus architectures. In particular, the system bus 906 facilitates data and information communication between the various components (whether internal or external to the computer 900) through a variety of interfaces, as discussed hereinafter.

The computer 900 may include a variety of discrete computer-readable media components. For example, this computer-readable media may include any media that can be accessed by the computer 900, such as volatile media, non-volatile media, removable media, non-removable media, etc. As a further example, this computer-readable media may include computer storage media, such as media implemented in any method or technology for storage of information, such as computer-readable instructions, data structures, program modules, or other data, random access memory (RAM), read only memory (ROM), electrically erasable programmable read only memory (EEPROM), flash memory, or other memory technology, CD-ROM, digital versatile disks (DVDs), or other optical disk storage, magnetic cassettes, magnetic tape, magnetic disk storage, or other magnetic storage devices, or any other medium which can be used to store the desired information and which can be accessed by the computer 900. Further, this computer-readable media may include communications media, such as computer-readable instructions, data structures, program modules, or other data in other transport mechanisms and include any information delivery media, wired media (such as a wired network and a direct-wired connection), and wireless media. Computer-readable media may include all machine-readable media with the sole exception of transitory, propagating signals. Of course, combinations of any of the above should also be included within the scope of computer-readable media.

As seen in FIG. 1, the computer 900 further includes a system memory 908 with computer storage media in the form of volatile and non-volatile memory, such as ROM and RAM. A basic input/output system (BIOS) with appropriate computer-based routines assists in transferring information between components within the computer 900 and is normally stored in ROM. The RAM portion of the system memory 908 typically contains data and program modules that are immediately accessible to or presently being operated on by processing unit 904, e.g., an operating system, application programming interfaces, application programs, program modules, program data and other instruction-based computer-readable codes.

With continued reference to FIG. 1, the computer 900 may also include other removable or non-removable, volatile or non-volatile computer storage media products. For example, the computer 900 may include a non-removable memory interface 910 that communicates with and controls a hard disk drive 912, i.e., a non-removable, non-volatile magnetic medium; and a removable, non-volatile memory interface 914 that communicates with and controls a magnetic disk drive unit 916 (which reads from and writes to a removable, non-volatile magnetic disk 918), an optical disk drive unit 920 (which reads from and writes to a removable, non-volatile optical disk 922, such as a CD ROM), a Universal Serial Bus (USB) port 921 for use in connection with a removable memory card, etc. However, it is envisioned that other removable or non-removable, volatile or non-volatile computer storage media can be used in the exemplary computing system environment 900, including, but not limited to, magnetic tape cassettes, DVDs, digital video tape, solid state RAM, solid state ROM, etc. These various removable or non-removable, volatile or non-volatile magnetic media are in communication with the processing unit 904 and other components of the computer 900 via the system bus 906. The drives and their associated computer storage media discussed above and illustrated in FIG. 1 provide storage of operating systems, computer-readable instructions, application programs, data structures, program modules, program data and other instruction-based computer-readable code for the computer 900 (whether duplicative or not of this information and data in the system memory 908).

A user may enter commands, information, and data into the computer 900 through certain attachable or operable input devices, such as a keyboard 924, a mouse 926, etc., via a user input interface 928. Of course, a variety of such input devices may be utilized, e.g., a microphone, a trackball, a joystick, a touchpad, a touch-screen, a scanner, etc., including any arrangement that facilitates the input of data, and information to the computer 900 from an outside source. As discussed, these and other input devices are often connected to the processing unit 904 through the user input interface 928 coupled to the system bus 906, but may be connected by other interface and bus structures, such as a parallel port, game port, or a universal serial bus (USB) 921. Still further, data and information can be presented or provided to a user in an intelligible form or format through certain output devices, such as a monitor 930 (to visually display this information and data in electronic form), a printer 932 (to physically display this information and data in print form), a speaker 934 (to audibly present this information and data in audible form), etc. All of these devices are in communication with the computer 900 through an output interface 936 coupled to the system bus 906. It is envisioned that any such peripheral output devices be used to provide information and data to the user.

The computer 900 may operate in a network environment 938 through the use of a communications device 940, which is integral to the computer or remote therefrom. This communications device 940 is operable by and in communication to the other components of the computer 900 through a communications interface 942. Using such an arrangement, the computer 900 may connect with or otherwise communicate with one or more remote computers, such as a remote computer 944, which may be a personal computer, a server, a router, a network personal computer, a peer device, or other common network nodes, and typically includes many or all of the components described above in connection with the computer 900. Using appropriate communication devices 940, e.g., a modem, a network interface or adapter, etc., the computer 900 may operate within and communicate through a local area network (LAN) and a wide area network (WAN), but may also include other networks such as a virtual private network (VPN), an office network, an enterprise network, an intranet, the Internet, etc. It will be appreciated that the network connections shown are exemplary and other means of establishing a communications link between the computers 900, 944 may be used.

As used herein, the computer 900 includes or is operable to execute appropriate custom-designed or conventional software to perform and implement the processing steps of the method and system of the present invention, thereby, forming a specialized and particular computing system. Accordingly, the presently-invented method and system may include one or more computers 900 or similar computing devices having a computer-readable storage medium capable of storing computer-readable program code or instructions that cause the processing unit 904 to execute, configure or otherwise implement the methods, processes, and transformational data manipulations discussed hereinafter in connection with the present invention. Still further, the computer 900 may be in the form of any type of computing device having the necessary processing hardware to appropriately process data to effectively implement the presently-invented computer-implemented method and system.

As discussed hereinafter, the arrival time and location targeting system and method of the present invention may be implemented by, programmed or configured on, or otherwise associated with any type of computer or processor, such as one or more of the following: a specially-programmed computer, an on-board controller, an on-board computer 10 (as discussed hereinafter), a train management computer, a remote server, a back office server, a wayside device, a PTC component, a networked computer, or any combination thereof. Accordingly, some or all of the steps in the system, process, and method discussed hereinafter may be implemented and/or executed on-board a locomotive or control car (L), and similarly, some or all of the steps in the system, process, and method discussed hereinafter may be implemented and/or executed by a computer or processor that is remote from the train (TR), where the remote computer or processor is in direct or indirect communication with a communication device 12 of the train (TR).

Figure 2A:
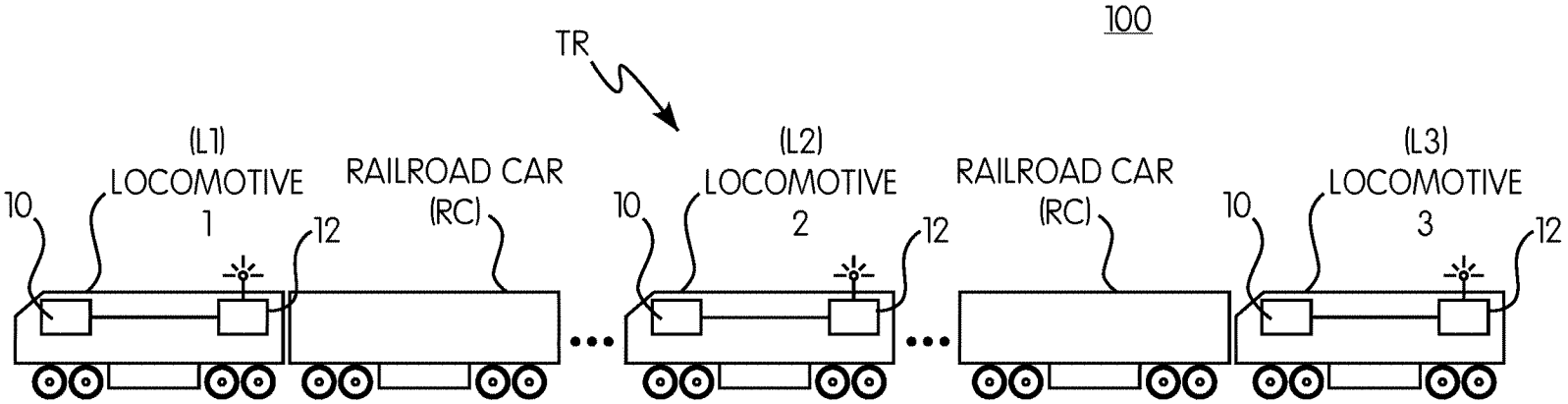
FIG. 2A is a schematic view of a train control system according to the principles of the present invention.
Figure 2B:
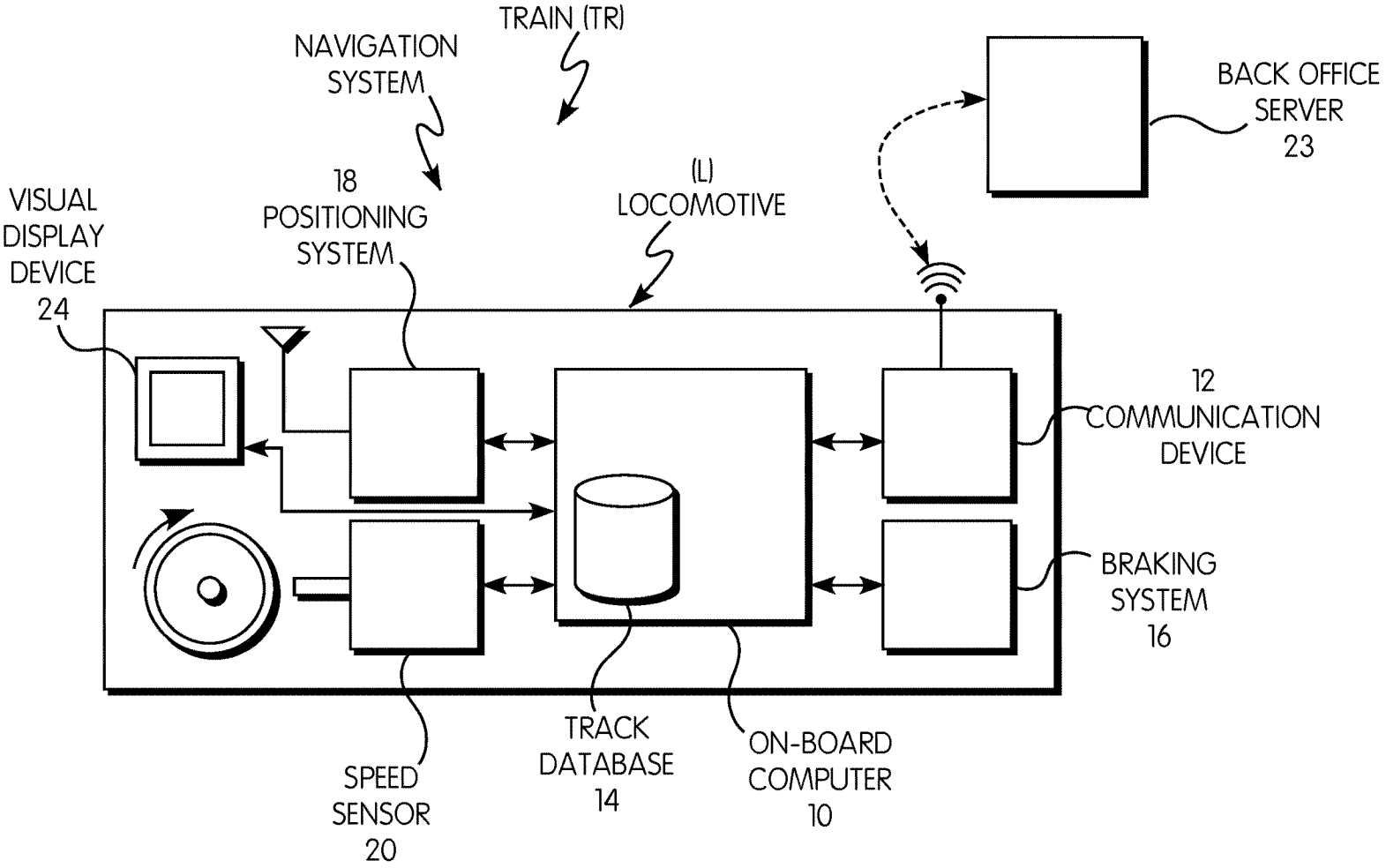
FIG. 2B is a schematic view of one embodiment of an arrival time and location targeting system according to the principles of the present invention.

With specific reference to FIGS. 2A and 2B, and in one preferred and non-limiting embodiment or aspect, provided is an arrival time and location targeting system for a train (TR) including at least one locomotive or control car (L) and, optionally, one or more railcars (RC). For example, in one implementation, the train (TR) may include a plurality of locomotives (L1, L2, L3) and a plurality of rail cars (RC). In another implementation, the train (TR) may include only a single locomotive (L) and no rail cars (RC). The locomotive(s) (L) are equipped with at least an on-board computer 10 (e.g., an on-board controller, a train management computer, an on-board processor, and/or the like) programmed or configured to implement or facilitate at least one train action and a communication device 12 in communication with the on-board computer 10 and programmed or configured to receive, transmit, and/or process data signals. While the communication device 12 may be in the form of a wireless communication device (as illustrated in FIG. 2B), as discussed herein, this communication device 12 may also be programmed or configured to transmit, process, and/or receive signals over a trainline, using an ECP component, over the rails, and/or the like.

The system architecture used to support the functionality of at least some of the methods and systems described herein includes: the train management computer or on-board computer 10 (which performs calculations for or within the Positive Train Control (PTC) system, including navigation and enforcement calculations); the communication device 12 (or data radio) (which may be used to facilitate the communications between the on-board computers 10 in one or more of the locomotives or control cars (L) of a train (TR), communications with a wayside device, e.g., signals, switch monitors, wayside devices, and the like, and/or communications with a remote server, e.g., a back office server 23, a central controller, central dispatch, and/or); a track database 14 (which may include information about track positions or locations, switch locations, crossing locations, track heading changes, e.g., curves, distance measurements, train information, e.g., the number of locomotives or control cars (L), the number of railcars (RC), the number of conventional passenger cars, the number of control cars, the total length of the train (TR), the specific identification numbers of each locomotive or control car (L) where PTC equipment (e.g., an on-board computer 10) is located, and the like); a navigation system 16 (optionally including a positioning system 18 (e.g., a Global Positioning System (GPS)) and/or a wheel tachometer/speed sensor 20), such as in a PTC-equipped locomotive or control car (L); and a visual display device 24 (or operator interface), typically located in the locomotive or control car (L), which is in direct or indirect communication with the on-board computer 10 and provides information and data to the operator, such as the information, data, and/or screens as discussed hereinafter. It should also be recognized that some or all of the steps and processing described herein may be performed locally by the on-board computer 10 of the locomotive or control car (L), or alternatively, by another computer (e.g., a computer associated with the end-of-train unit, a computer associated with a wayside device, and the like) and/or a remote computer or server (e.g., the back office server 23, a remote computer or server associated with central dispatch, a central controller, a computer-aided dispatch system, and intermediate control computer, and the like).

Further, and as discussed, the on-board computer 10 includes or is in communication with the communication device 12 (e.g., a data radio, a communication interface, a communication component, and/or the like), which facilitates communication by or between locomotives or control cars (L) and/or the locomotive or control car (L) and some remote server or computer system, e.g., a central controller, a back office server 23, a remote server, central dispatch, back office PTC components, various wayside devices, such as signal or switch monitors, or other on-board computers 10 in the railway system. Further, this communication may occur wirelessly or in a "hard wired" form, e.g., over the rails of the track.

As discussed, the on-board computer 10 may be located at any position or orientation on the train (TR), and the on-board computer 10 (or on-board controller, on-board computer system, train management computer, and/or the like, and which performs the determinations and/or calculations for the Positive Train Control (PTC) system) includes or is in communication with the track database 14 populated with data and/or which receives specified data and information from other trains, remote servers, back office servers 23, central dispatch, and/or the like, where this data may include track profile data, train data, information about switch locations, track heading changes (e.g., curves, and distance measurements), train consist information (e.g., the number of locomotives, the number of cars, the total length of the train (TR)), and/or the like. Of course, it is envisioned that any type of train management system can be used within the context and scope of the present invention.

Figure 3:
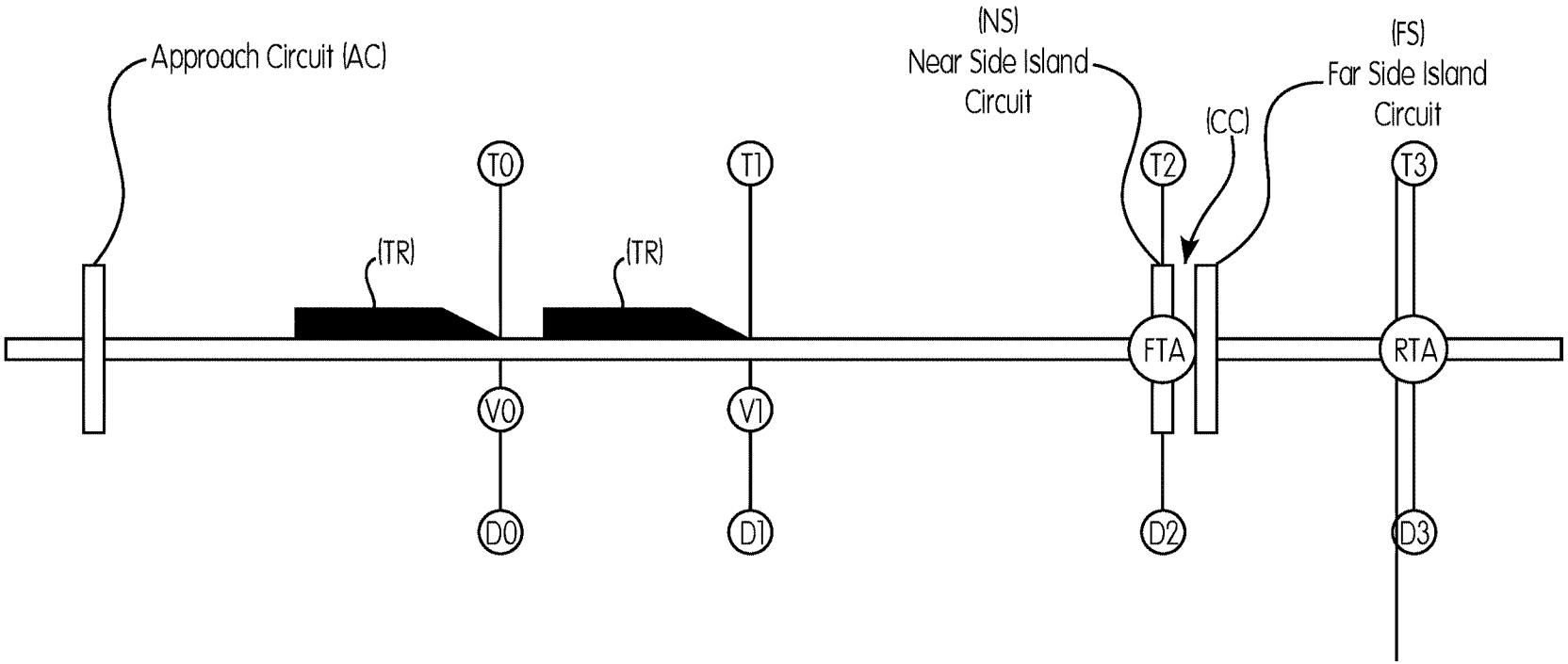
FIG. 3 is a schematic view of one implementation of an arrival time and location targeting system according to the principles of the present invention.

FIG. 3 is a schematic view of one exemplary implementation of an arrival time and location targeting system according to the principles of the present invention. The on-board computer (10) for an arrival time and location targeting system according to one preferred and non-limiting embodiment or aspect is programmed or configured to receive at least one target location associated with a forward route of the train (TR). For example, the at least one target location can be associated with at least one of the following: a crossing, a safety target, a track section, a track location, a specified location, a restricted speed location, a circuit, a restricted noise location, or any combination thereof. In FIG. 3, the target location is the near side (NS) of an island crossing circuit (CC). The at least one target location can be stored in at least one database, e.g., the track database 14 and/or at a database at the back office server 23, and the on-board computer (10) is in direct or indirect communication with the at least one database. For example, in one preferred and non-limiting embodiment or aspect, the at least one database can comprise the track database 14 in a PTC system.

The on-board computer (10) (and/or a remote processor or server, e.g., the back office server 23) is programmed or configured to determine required time of arrival (RTA) at the at least one target location based at least partially on the current location of a leading edge of the train (TR). For example, the RTA point or circle in FIG. 3, which is associated with T3, i.e., RTA, and D3, is the location at which the train (TR) is currently projected to be located at the required (or desired) time of arrival based on current conditions of the (TR). The on-board computer (10) (and/or a remote processor or server, e.g., the back office server 23) is programmed or configured to determine an estimated time of arrival (ETA) of the leading edge of the train (TR) at the at least one target location based at least partially on the current location of the leading edge of the train (TR) and the current speed of the train (TR). For example, the ETA point or circle in FIG. 3, which is associated with T2, i.e., ETA, and D2, is the location of the target location and corresponds to the estimated time of arrival of the train (TR) at the near side (NS) of the island crossing circuit (CC) based on current conditions of the train (TR).

FIG. 3 represents two points in time, namely a present point in time and a future point in time overlaid on a piece of track with an optional approach circuit (AC) and the island crossing circuit (CC) including the near side island circuit (NS) (in this example the target location) and a far side island circuit (FS). The variable indices 0, 2, and 3 are used for the present point in time and the variable indices 1, 2, and 3 are used for the future point in time. For a first point in time, e.g., the present point in time, the ETA can be determined based at least partially on the current location of the leading edge of the train (TR), the current speed of the train (TR), and the time difference between the ETA and a current time. For example, the present point in time represents the present time and shows the time, location, and velocity (or speed) of the leading edge of the train (TR) and the time and locations of both the ETA and RTA of the target location, i.e., the near side (NS) of the island crossing circuit (CC). The ETA and RTA are shown to be offset and depict an early arrival condition in FIG. 3.

For a second, future point, e.g., the future point in time, the RTA can be determined based at least partially on the at least one target location, a predicted location of the leading edge of the train (TR), a predicted speed of the train (TR), and the time difference between the RTA and a predicted time. The predicted location of the leading edge of the train (TR) can be determined at least partially based on the current location of the leading edge of the train (TR), the difference in speed between the current velocity or speed of the train (TR), and the predicted velocity (or speed) of the train (TR), and the time difference between the current time and the predicted time. For example, the future point in time represents a time in the future and shows the time, location, and velocity (or speed) of the leading edge of the train (TR) and the time and location of the ETA and RTA of the crossing.

For the future point in time, it is an objective of an arrival time and location targeting system according to a preferred and non-limiting embodiment or aspect for the ETA and RTA to be substantially the same point both in time and location. The on-board computer (10) (and/or a remote processor or server, e.g., the back office server 23) is programmed or configured to generate a target speed of the train (TR) based at least partially on the difference between the determined required time of arrival and the determined estimated time of arrival, i.e., between the RTA and the ETA.

For example, for the present point in time in FIG. 3, the on-board computer (10) (and/or a remote processor or server, e.g., the back office server 23) can determine the ETA location based on an initial location, speed, and time difference of the train (TR) according to the following Equation (1):

$$D2=D0+V0(T2-T0) \tag{1}$$

wherein D0 is a current location of the leading edge of the train (TR) at the present point in time, V0 is a current velocity (or speed) of the leading edge of the train (TR) at the present point in time, T0 is a current time at the present point in time, D2 is an estimated location of the leading edge of the train (TR) determined at the present point in time, i.e., the ETA location, and T2 is the current ETA of the leading edge of the train (TR) at the target location determined at the present point in time.

For the future point in time in FIG. 3, the on-board computer (10) can determine the RTA location based on a future location, speed, and time difference of the train (TR) according to the following Equation (2):

$$D3=D1+V1(T3-T1) \tag{2}$$

wherein D1 is a current location of the leading edge of the train (TR) at the future point in time, V1 is a current velocity (or speed) of the leading edge of the train (TR) at the future point in time, T1 is a current time at the future point in time, D3 is the required or desired location of the leading edge of the train (TR) determined at the future point in time, i.e., the RTA location, and T3 is the RTA of the leading edge of the train (TR) at the target location determined at the future point in time.

The on-board computer (10) (and/or a remote processor or server, e.g., the back office server 23) can determine a future location of the train (TR) based on the original location, a velocity (or speed) difference, and a time difference according to the following Equation (3):

$$D1 = D0 + (T1 - T0)\left(\frac{V0 + V1}{2}\right) \tag{3}$$

wherein the variables D0, D1, T0, T1, V0, and V2 are the same as in Equations (1) and (2).

Equations (1) to (3) can be simplified for reduction by substitution. For example, T0 and D0 can be set to 0 because anything that happens prior to the present point in time does not affect the system. Accordingly, the Equations (1), (2), and (3) can be respectively reduced by substitution to the following Equations (4), (5), and (6):

$$D2 = V0(T2) \tag{4}$$

$$D3 = D1 + V1(T3 - T1) \tag{5}$$

-continued $$D1 = (T1)\left(\frac{(V0 + V1)}{2}\right) \tag{6}$$

As previously noted, it is an objective of the arrival time and location targeting system according to a preferred and non-limiting embodiment or aspect for the ETA and RTA to be substantially the same point both in time and location. Accordingly, D2 can be set to be equal to D3 to arrive at the following Equation (7):

$$V0(T2)=D1+V1(T3-T1) \tag{7}$$

Further substitutions with Equations (4) to (7) can provide the following Equations (8) to (11):

$$V0(T2) = (T1)\left(\frac{V0 + V1}{2}\right) + V1(T3 - T1) \tag{8}$$

$$V0 * T2 = \frac{T1 * V0}{2} + \frac{T1 * V1}{2} + V1 * T3 - V1 * T1 \tag{9}$$

$$V0 * T2 - V0\frac{T1}{2} = V1\frac{T1}{2} + V1 * T3 - V1 * T1 \tag{10}$$

$$V0\left(T2 - \frac{T1}{2}\right) = V1\left(T3 - \frac{T1}{2}\right) \tag{11}$$

The Equations (8) to (11) can be further reduced by substitution to the following Equation (12):

$$V1 = V0\left(\frac{T2 - \frac{T1}{2}}{T3 - \frac{T1}{2}}\right) \tag{12}$$

The on-board computer (10) (and/or a remote processor or server, e.g., the back office server 23) is accordingly programmed or configured to generate a target speed of the train (TR) based at least partially on the difference between the determined required time of arrival and the determined estimated time of arrival, i.e., between the RTA and the ETA. For example, the on-board computer (10) (and/or a remote processor or server, e.g., the back office server 23) can use Equation (12) to generate a target speed or velocity of the train (TR) that results in the ETA being equal to the RTA. As previously noted, the RTA can be determined, for a second, future point, e.g., the future point in time, based at least partially on the at least one target location, a predicted location of the leading edge of the train (TR), a predicted speed of the train (TR), and the time difference between the RTA and a predicted time.

The on-board computer 10 (and/or a remote processor or server, e.g., the back office server 23) can determine the predicted time based at least partially on at least one of a nominal or allowable acceleration constant for the train (TR) and a nominal or allowable deceleration constant for the train (TR). For example, in the above Equations (1) to (12), a value for T1 may be based on a nominal acceleration (or deceleration) constant for the train (TR). For example, V1 can be represented by the following Equation (13):

$$V1=V0+\text{accel}*T1 \tag{13}$$

The V1 from Equation (13) can be substituted into Equation (12) to solve for T1, and a value for V1 can be calculated by substituting the value of T1 back into Equation (13), which results in the following quadratic Equation (14):

$$\left(\frac{accel}{2}\right)T1^2 - (accel * T3)T1 - V0(T3 - T2) = 0 \tag{14}$$

In another embodiment or aspect, Equation (13) can be reordered by substituting T1 into Equation (12) to solve for V1 directly, which results in the following quadratic Equation (15):

$$\left(\frac{1}{2 * accel}\right)V1^2 - \left(\frac{V0}{accel} + T3\right)V1 + \left(\frac{V0^2}{2 * accel} + V0 * T2\right) = 0 \tag{15}$$

Either quadratic Equation (14) or quadratic Equation (15) can be solved by the quadratic formula, which is represented in the following Equation (16):

$$x = \frac{-b \mp \sqrt{b^2 - 4 * a * c}}{2 * a} \tag{16}$$

where $$a = \left(\frac{accel}{2}\right), = -(accel * T3), c = -V0(T3 - T2) \text{ OR}$$

$$a = \left(\frac{1}{2 * accel}\right), b = -\left(\frac{V0}{accel} + T3\right),$$

$$c = \left(\frac{V0^2}{2 * accel} + V0 * T2\right)$$

The quadratic formula always gives two possible results or answers. Sometimes the results of the quadratic formula are imaginary. If the results are imaginary, the on-board computer (10) determines that the RTA cannot be met in time given the input data. For example, if the on-board computer (10) (and/or a remote processor or server, e.g., the back office server 23) determines that the RTA cannot be met, the on-board computer (10) can determine and/or implement a stop target for the train (TR).

If the results of the quadratic formula are a positive real value, the on-board computer (10) can determine the required acceleration (or deceleration) time to generate the target speed of the train (TR) to meet the RTA. For example, if the on-board computer (10) determines that deceleration of the train (TR) is required to meet the RTA, an answer used to determine the required time T1 is the positive version of the quadratic formula, which is represented in the following Equation (17):

$$x = \frac{-b + \sqrt{b^2 - 4 * a * c}}{2 * a} \tag{17}$$

Substituting and solving the Equation (14) (or the Equation (15)) using the positive version of the quadratic formula yields a time value T1. If the answer is a positive real value, i.e., not imaginary, the RTA target speed can be calculated. Further checks can be performed by the on-board computer (and/or a remote processor or server, e.g., the back office server 23) to determine if the answer is realistic. For example, if the calculated time value T1 is longer than the remaining RTA time, the train (TR) is going to arrive early. In this scenario, the on-board computer (10) can automatically issue a stop target (0 MPH target speed).

In a preferred and non-limiting embodiment or aspect, the on-board computer (10) (and/or a remote processor or server, e.g., the back office server 23) can be programmed or configured to implement or cause the implementation of at least one braking enforcement action based on the difference between the determined required time of arrival and the determined estimated time of arrival, the current velocity or speed of the train (TR), and/or the current location of the leading edge of the train (TR). For example, if the target speed of the train (TR) speed is less than the current speed of the train (TR), the on-board computer (10) can determine that deceleration is required to meet the RTA, and automatically implement or trigger the implementation of at least one braking enforcement action based on the difference between the target speed of the train (TR) and the current speed of the train (TR) and the current track and train conditions. The on-board computer (10) can implement the braking based on a desired or known deceleration rate caused by the application of the train brakes and the current conditions of the track and train to modify the speed of the train (TR) to meet the target speed. However, the on-board computer (10) (and/or a remote processor or server, e.g., the back office server 23) need not implement or trigger the implementation of a braking enforcement action under such a desired negative acceleration condition until the on-board computer (10) determines that a stop target must be enforced, thereby leaving the control of braking to an operator of the train (TR) as discussed in more detail below.

If the on-board computer (10) determines that acceleration of the train (TR) is required to meet the RTA, an answer used for the required time T1 is the negative version of the quadratic formula, which is represented in the following Equation (18):

$$x = \frac{-b - \sqrt{b^2 - 4 * a * c}}{2 * a} \tag{18}$$

Substituting and solving the Equation (14) (or the Equation (15)) using the negative version of the quadratic formula yields a time value T1. If the answer is a positive real value, i.e., not imaginary, the RTA target speed can be calculated. However, the on-board computer (10) (and/or a remote processor or server, e.g., the back office server 23) need not enforce anything under such a positive acceleration condition and, if an unrealistic answer or a value that leads to a speed above the design speed of the island crossing circuit (CC) is generated, the on-board computer (10) (and/or a remote processor or server, e.g., the back office server 23) can set the target speed to be the design speed of the island crossing circuit (CC).

In another preferred and non-limiting embodiment or aspect, the on-board computer (10) (and/or a remote processor or server, e.g., the back office server 23) can be programmed or configured to implement or cause the implementation of at least one tractive effort based on the difference between the determined required time of arrival and the determined estimated time of arrival, the current speed of the train (TR), and/or the current location of the leading edge of the train (TR). For example, if the target speed of the train (TR) is greater than the current speed of the train (TR), the on-board computer (10) (and/or a remote processor or server, e.g., the back office server 23) can determine that acceleration is required to meet the RTA, and automatically implement or cause the implementation of at least one tractive effort based on the difference between the target speed of the train (TR) and the current speed of the train (TR). The on-board computer (10) (and/or a remote processor or server, e.g., the back office server 23) can implement the tractive effort based on a desired or known acceleration rate caused by the application of the tractive effort and the current conditions of the track and train (TR) to modify the speed of the train (TR) to meet the target speed. However, as noted again, the on-board computer (10) (and/or a remote processor or server, e.g., the back office server 23) need not implement or trigger the implementation of a tractive effort under such a desired positive acceleration condition, and can leave the control of acceleration to an operator of the train (TR) as discussed in more detail below.

The on-board computer (10) (and/or a remote processor or server, e.g., the back office server 23) can generate the target speed of the train (TR) based at least partially on the difference between the determined required time of arrival and the determined estimated time of arrival, i.e., between the RTA and the ETA, continuously, periodically, on a set interval, at least partially based upon a speed of the train (TR), at least partially based upon the location of at least a portion of the train (TR), at least partially based upon the location of a leading edge of the train (TR), at least partially based upon at least one braking prediction process, or any combination thereof. For example, the on-board computer (10) (and/or a remote processor or server, e.g., the back office server 23) can receive a target location, determine RTA, determine ETA, and/or determine a target speed periodically, on a set interval, at least partially based upon a speed of the train (TR), at least partially based upon the location of at least a portion of the train (TR), at least partially based upon the location of a leading edge of the train (TR), at least partially based upon at least one braking prediction process, or any combination thereof. The target speed of the train (TR) can be greater than, less than, or substantially the same as the current speed of the train (TR). Accordingly, the on-board computer (10) (and/or a remote processor or server, e.g., the back office server 23) can be programmed or configured to implement or cause the implementation a braking action, a tractive effort, or maintenance of the current speed of the train (TR).

Examples in which the Equation (14) is used to calculate the required acceleration (or deceleration) time T1 to determine to a target speed to meet RTA are discussed below. In the examples that follow, the following 4 known variables used to determine the RTA Target speed: accel/decel, V0, D2, and T3. For these examples ±2 MPH/s (or 2.93333 fps/s) is used for the acceleration and deceleration values. As a reminder, T0 and D0 can be set to 0 (zero). It is noted that the Equation (15) can be used in place of the Equation (14) in the below examples to arrive at the same target speeds, and that the Equations (14) and (15) can be solved by methods other than the quadratic equation, such as by graphing or other mathematical methodology.

Example 1

In a first example, a train (TR) is approaching an island crossing circuit (CC) that is 1 mile ahead with a current velocity or speed of 60 Mph and an RTA of 70 seconds. Accordingly, the following variables are known: V0=60 Mph=88 fps; D2=5280 ft; T3=70 seconds. Equation (1) can be used to calculate T2, i.e., ETA, in the following manner:

$$5280 = 0 + 88(T2 - 0)$$

$$T2 = \left(\frac{5280}{88}\right) = 60 \text{ seconds}$$

For an ETA of 60 seconds and an RTA of 70 seconds, the on-board computer 10 (and/or a remote processor or server, e.g., the back office server 23) can determine that the train (TR) will arrive 10 seconds earlier than allowed. The on-board computer (10) (and/or a remote processor or server, e.g., the back office server 23) can complete the algorithm to determine the required acceleration (or deceleration) time to generate the target speed of the train (TR) to meet the RTA. For example, using ±2 MPH/s (or 2.93333 fps/s) for the acceleration and deceleration values, the on-board computer (10) (and/or a remote processor or server, e.g., the back office server 23) can solve the Equation (14) via the quadratic equation in the following manner:

$$a = \left(\frac{accel}{2}\right),\ b = -(accel * T3),\ c = -V0(T3 - T2)$$

$$a = \left(\frac{-2.93333}{2}\right),\ b = -(-2.93333 * 70),\ c = -88(70 - 60)$$

$$a = -1.46666,\ b = 205.33333,\ c = -880$$

$$x = \frac{-205.33333 + \sqrt{205.33333^2 - 4 * -1.46666 * -880}}{2 * -1.46666}$$

$$x = \frac{-205.33333 + \sqrt{36999.1332}}{-2.93333} = \frac{-205.33333 + 192.35158}{-2.93333} = 4.425 \text{ seconds}$$

The on-board computer (10) (and/or a remote processor or server, e.g., the back office server 23) can solve for V1 based on the required time T1 of 4.425 seconds in the following manner:

$$V1 = V0 + \text{accel} * T1$$

$$V1 = 88 + (-2.93333 * 4.425)$$

$$V1 = 75.020 \text{ fps} = 51.15 \text{ MPH}$$

The on-board computer (10) (and/or a remote processor or server, e.g., the back office server 23) can thus determine that if the train (TR) slows down to 51.15 Mph within 4.425 seconds, the leading edge of the train (TR) will reach the near side (NS) island crossing at the desired RTA, i.e., ETA will be equal to RTA.

Example 2

In a second example, the same setup as the first example is used, but the train (TR) is propagated down the track at 60 Mph while keeping the same RTA offset and adjusting the D2 variable to account for distance traveled by the train (TR). The effect on the RTA target speed can thus be determined. For example, 5 seconds into the future from the first example, the train (TR) will have traveled 440 ft at 60 Mph, so the new value for D2 is 4840 ft. The on-board computer (10) (and/or a remote processor or server, e.g., the back office server 23) can solve for T2, i.e., the ETA, in the following manner using Equation (1):

$$4840 = 0 + 88(T2 - 0)$$

$$T2 = \left(\frac{4840}{88}\right) = 55 \text{ seconds}$$

Because 5 seconds have passed since the original RTA offset of 70 seconds, the new RTA is 65 seconds. This changes the c value in the quadratic equation to the following: b=−(−2.93333*65)=190.667. When the on-board computer (10) (and/or a remote processor or server, e.g., the back office server 23) solves the quadratic equation again, it determines that x=4.792 seconds, and a new V1 in the following manner:

$$V1=88+(-2.93333*4.792)$$

$$V1=73.943 \text{ fps}=50.42 \text{ MPH}$$

The on-board computer (10) (and/or a remote processor or server, e.g., the back office server 23) can thus determine that if the train (TR) slows down to 50.42 Mph within 4.792 seconds, the leading edge of the train (TR) will reach the near side island crossing (NS) at the desired RTA, i.e., ETA will be equal to RTA. Accordingly, the longer the train (TR) waits to start slowing down, the lower the speed that the train (TR) ultimately needs to reach in order to reach the RTA. The following table shows the second example extended even further into the future. For example, the train (TR) is propagated down the track at 60 Mph while keeping the same RTA offset and adjusting the D2 variable to account for distance traveled.

TABLE 1

| | | | | |
|---|---|---|---|---|
| @ 10 seconds | ETA = 50 seconds | RTA = 60 seconds | x = 5.228 seconds | V1 = 72.665 fps = 49.54 MPH |
| @ 20 seconds | ETA = 40 seconds | RTA = 50 seconds | x = 6.411 seconds | V1 = 69.194 fps = 47.18 MPH |
| @ 30 seconds | ETA = 30 seconds | RTA = 40 seconds | x = 8.377 seconds | V1 = 63.427 fps = 43.25 MPH |
| @ 40 seconds | ETA = 20 seconds | RTA = 30 seconds | x = 12.679 seconds | V1 = 50.807 fps = 34.64 MPH |
| @ 41 seconds | ETA = 19 seconds | RTA = 29 seconds | x = 13.476 seconds | V1 = 48.471 fps = 33.05 MPH |
| @ 42 seconds | ETA = 18 seconds | RTA = 28 seconds | x = 14.435 seconds | V1 = 45.656 fps = 31.13 MPH |
| @ 43 seconds | ETA = 17 seconds | RTA = 27 seconds | x = 15.642 seconds | V1 = 42.116 fps = 28.72 MPH |
| @ 44 seconds | ETA = 16 seconds | RTA = 26 seconds | x = 17.282 seconds | V1 = 37.306 fps = 25.44 MPH |
| @ 45 seconds | ETA = 15 seconds | RTA = 25 seconds | x = 20.000 seconds | V1 = 29.333 fps = 20.00 MPH |

The target speed that the train (TR) ultimately needs to reach in order to meet RTA will eventually reach a point that is impossible to obtain and the quadratic equation gives an imaginary answer. For example, the next line in Table 1, i.e., @ 46 seconds, would give an imaginary answer for the target speed of the train. It can also been seen from Table 1 that the longer a correction in the current speed of the train (TR) is delayed, the faster the RTA target speed changes, e.g., drops in a deceleration scenario. It is noted that a PTC system (e.g., the I-ETMS® of Wabtec Corp.) using these calculated speeds for an RTA target would have warned and enforced a stop target for the train (TR) long before the quadratic equation would begin giving imaginary answers.

Example 3

In a third example, a train (TR) is approaching an island crossing circuit (CC) that is 1 mile ahead with a current velocity of 60 Mph and an RTA of 50 seconds. Accordingly, the flowing variables are known: V0=60 MPH=88 fps; D2=5280 ft; and T3=50 seconds. The on-board computer (10) (and/or a remote processor or server, e.g., the back office server 23) can calculate T2, i.e., ETA in the following manner: T2=(5280/88)=60 seconds. When an ETA is greater than an RTA, a situation where the train (TR) will arrive at the target stop later than required or desired is determined. This is not necessarily an issue for certain PTC systems, but can cause unnecessary delays, extended crossing activation times, etc. Using ±2 MPH/s (or 2.93333 fps/s) for the acceleration and deceleration values, the on-board computer (10) (and/or a remote processor or server, e.g., the back office server 23) can determine the required acceleration time by solving the quadratic equation in the following manner:

$$a=\left(\frac{2.93333}{2}\right),\ b=-(2.93333*50),\ c=-88(50-60)$$

$$a=1.46666,\ b=-146.6666,\ c=880$$

$$x=\frac{-(-146.6666)-\sqrt{(-146.6666)^2-4*1.46666*880}}{2*1.46666}$$

-continued $$x=\frac{146.6666-\sqrt{16348.44}}{2.93333}=\frac{146.6666-127.861}{2.93333}=6.411 \text{ seconds}$$

The on-board computer (10) (and/or a remote processor or server, e.g., the back office server 23) solves for V1 based on the result of the quadratic equation, i.e., the required acceleration time, in the following manner:

$$V1=V0+\text{accel}*T1$$

$$V1=88+(2.93333*6.411)$$

$$V1=106.806 \text{ fps}=72.82 \text{ MPH}$$

The on-board computer (10) (and/or a remote processor or server, e.g., the back office server 23) can thus determine that the train (TR) can speed up to 72.82 MPH within 6.411 seconds and still reach the near side island crossing (NS) at the desired RTA.

Example 4

In a fourth example, the same setup as the third example is used, but the train (TR) is propagated down the track at 60 MPH while keeping the same RTA offset and adjusting the D2 variable to account for the distance traveled by the train (TR). The effect on the RTA target speed can thus be determined. For example, 5 seconds into the future from the third example, the train will have traveled 440 ft at 60 MPH, so the new value for D2 is 4840 ft. The on-board computer (10) (and/or a remote processor or server, e.g., the back office server 23) can solve for T2, i.e., the ETA, in the following manner:

$$4840 = 0 + 88(T2 - 0)$$

$$T2 = \left(\frac{4840}{88}\right) = 55 \text{ seconds}$$

Since 5 seconds have passed since the original RTA offset of 50 seconds, the new RTA is 45 seconds. This changes the c value in the quadratic equation to the following: b=−(2.93333*45)=−132.0. When the on-board computer (10) (and/or a remote processor or server, e.g., the back office server 23) solves the quadratic equation again, it determines that the required acceleration time is x=7.251 seconds, and a new V1 in the following manner:

$$V1=88+(2.93333*7.251)$$

$$V1=109.269 \text{ fps}=74.50 \text{ MPH}$$

The on-board computer (10) (and/or a remote processor or server, e.g., the back office server 23) can thus determine that the train (TR) can speed up to 74.50 MPH within 7.251 seconds and still reach the near side island crossing (NS) at the desired RTA. Accordingly, the longer the train (TR) waits to start speeding up, the higher the speed that the train (TR) ultimately needs to reach in order to meet the RTA. The following table shows the fourth example extended even further into the future. For example, the train (TR) is propagated down the track at 60 Mph while keeping the same RTA offset and adjusting the D2 variable to account for distance traveled.

TABLE 2

| | | | | |
|---|---|---|---|---|
| @ 10 seconds | ETA = 50 seconds | RTA = 60 seconds | x = 8.377 seconds | V1 = 112.573 fps = 76.75 MPH |
| @ 20 seconds | ETA = 40 seconds | RTA = 50 seconds | x = 12.679 seconds | V1 = 125.193 fps = 85.36 MPH |
| @ 21 seconds | ETA = 39 seconds | RTA = 49 seconds | x = 13.476 seconds | V1 = 127.529 fps = 86.95 MPH |
| @ 22 seconds | ETA = 38 seconds | RTA = 48 seconds | x = 14.435 seconds | V1 = 130.344 fps = 88.87 MPH |
| @ 23 seconds | ETA = 37 seconds | RTA = 47 seconds | x = 15.642 seconds | V1 = 133.884 fps = 91.28 MPH |
| @ 24 seconds | ETA = 36 seconds | RTA = 46 seconds | x = 17.282 seconds | V1 = 138.694 fps = 94.56 MPH |
| @ 25 seconds | ETA = 35 seconds | RTA = 45 seconds | x = 20.000 seconds | V1 = 146.667 fps = 100.00 MPH |

The speed that the train (TR) ultimately needs to reach in order to meet the RTA will eventually reach a point that is impossible to obtain and the quadratic equation gives an imaginary answer. For example, the next line in Table 1, i.e., @ 26 seconds, would give an imaginary answer for the target speed of the train. It can also be seen from Table 2 that the longer a correction is delayed, the faster the RTA target speed changes, e.g., rises.

Example 5

In a fifth example, a typical scenario where an initial RTA is 6 seconds less than a current ETA can be used to represent an allowable safety factor for additional acceleration after the RTA is set. Referring to the below table, in the V1 column, the train (TR) initially has room to speed up to about 67 MPH. As the train (TR) speeds up, V1 tops out at about 67 MPH and starts to drop as the new ETAs get farther away from the RTA. This example shows the train (TR) speeding up to 79 MPH and holding that speed until the algorithm fails to calculate an answer.

TABLE 3

| V0 (mph) | V0 (fps) | T1 (s) | V1 (mph) | V1 (fps) | ETA T2 (s) | D2 (ft) | RTA T3 (s) | D3 (ft) |
|---|---|---|---|---|---|---|---|---|
| 60.00 | 88.00 | 3.443 | 66.89 | 98.100 | 60.00 | 5280.00 | 54.00 | 5280.00 |
| 61.00 | 89.47 | 2.975 | 66.95 | 98.193 | 58.02 | 5191.27 | 53.00 | 5191.27 |
| 62.00 | 90.93 | 2.503 | 67.01 | 98.274 | 56.10 | 5101.07 | 52.00 | 5101.07 |
| 63.00 | 92.40 | 2.026 | 67.05 | 98.342 | 54.21 | 5009.40 | 51.00 | 5009.40 |

TABLE 3-continued

| V0 (mph) | V0 (fps) | T1 (s) | V1 (mph) | V1 (fps) | ETA T2 (s) | D2 (ft) | RTA T3 (s) | D3 (ft) |
|---|---|---|---|---|---|---|---|---|
| 64.00 | 93.87 | 1.544 | 67.09 | 98.395 | 52.38 | 4916.27 | 50.00 | 4916.27 |
| 65.00 | 95.33 | 1.057 | 67.11 | 98.435 | 50.58 | 4821.67 | 49.00 | 4821.67 |
| 66.00 | 96.80 | 0.566 | 67.13 | 98.460 | 48.82 | 4725.60 | 48.00 | 4725.60 |
| 67.00 | 98.27 | 0.069 | 67.14 | 98.470 | 47.10 | 4628.07 | 47.00 | 4628.07 |
| 68.00 | 99.73 | 0.437 | 67.13 | 98.452 | 45.41 | 4529.07 | 46.00 | 4529.07 |
| 69.00 | 101.20 | 0.960 | 67.08 | 98.383 | 43.76 | 4428.60 | 45.00 | 4428.60 |
| 70.00 | 102.67 | 1.503 | 66.99 | 98.258 | 42.14 | 4326.67 | 44.00 | 4326.67 |
| 71.00 | 104.13 | 2.067 | 66.87 | 98.070 | 40.56 | 4223.27 | 43.00 | 4223.27 |
| 72.00 | 105.60 | 2.655 | 66.69 | 97.811 | 39.00 | 4118.40 | 42.00 | 4118.40 |
| 73.00 | 107.07 | 3.271 | 66.46 | 97.473 | 37.47 | 4012.07 | 41.00 | 4012.07 |
| 74.00 | 108.53 | 3.917 | 66.17 | 97.044 | 35.97 | 3904.27 | 40.00 | 3904.27 |
| 75.00 | 110.00 | 4.598 | 65.80 | 96.513 | 34.50 | 3795.00 | 39.00 | 3795.00 |
| 76.00 | 111.47 | 5.320 | 65.36 | 95.862 | 33.05 | 3684.27 | 38.00 | 3684.27 |
| 77.00 | 112.93 | 6.089 | 64.82 | 95.073 | 31.63 | 3572.07 | 37.00 | 3572.07 |
| 78.00 | 114.40 | 6.914 | 64.17 | 94.119 | 30.23 | 3458.40 | 36.00 | 3458.40 |
| 79.00 | 115.87 | 7.806 | 63.39 | 92.968 | 28.85 | 3343.27 | 35.00 | 3343.27 |
| 79.00 | 115.87 | 8.106 | 62.79 | 92.089 | 27.85 | 3227.40 | 34.00 | 3227.40 |
| 79.00 | 115.87 | 8.434 | 62.13 | 91.128 | 26.85 | 3111.53 | 33.00 | 3111.53 |
| 79.00 | 115.87 | 8.794 | 61.41 | 90.070 | 25.85 | 2995.67 | 32.00 | 2995.67 |
| 79.00 | 115.87 | 9.194 | 60.61 | 88.897 | 24.85 | 2879.80 | 31.00 | 2879.80 |
| 79.00 | 115.87 | 9.641 | 59.72 | 87.587 | 23.85 | 2763.93 | 30.00 | 2763.93 |
| 79.00 | 115.87 | 10.145 | 58.71 | 86.107 | 22.85 | 2648.07 | 29.00 | 2648.07 |
| 79.00 | 115.87 | 10.723 | 57.55 | 84.413 | 21.85 | 2532.20 | 28.00 | 2532.20 |
| 79.00 | 115.87 | 11.396 | 56.21 | 82.440 | 20.85 | 2416.33 | 27.00 | 2416.33 |
| 79.00 | 115.87 | 12.198 | 54.60 | 80.086 | 19.85 | 2300.47 | 26.00 | 2300.47 |
| 79.00 | 115.87 | 13.189 | 52.62 | 77.179 | 18.85 | 2184.60 | 25.00 | 2184.60 |
| 79.00 | 115.87 | 14.487 | 50.03 | 73.372 | 17.85 | 2068.73 | 24.00 | 2068.73 |
| 79.00 | 115.87 | 16.405 | 46.19 | 67.747 | 16.85 | 1952.87 | 23.00 | 1952.87 |
| 79.00 | 115.87 | #NVM | #NVM | #NVM | 15.85 | 1837.00 | 22.00 | #NVM |

The on-board computer (10) is programmed or configured to display to at least one user on a visual display device, for example, on the visual display device 24 (or operator interface), in the at least one locomotive or control car (L): the estimated time of arrival, the required time of arrival, the current speed of the train (TR), the target speed of the train (TR), the at least one target location, the current location of the leading edge of the train (TR), braking data, alarm data, train data, track data, target location data, or any combination thereof. For example, as discussed herein, an arrival time and location targeting system according to preferred and non-limiting embodiments or aspects can enable the train (TR) to change speeds, while dynamically monitoring and enforcing a required or desired arrival time at a target location, e.g., a minimum allowable crossing time of an island crossing circuit (CC). As previously noted, due to the nature of crossings, the minimum allowable crossing time, i.e., a summation of the preemption time and warning time, must expire before the train (TR) can safely traverse the crossing. Preemption time is the amount of time required to activate automobile and pedestrian traffic signals ahead of the railroad crossing. Warning time is the amount of time the crossing gates are required to be active. By creating time-based targets, the train (TR) can be allowed to change speeds as long as a minimum allowable crossing time is met, and the onboard computer (10) (and/or a remote processor or server, e.g., the back office server 23) can be programmed or configured to enforce adequate warning and preemption times.

In one preferred and non-limiting embodiment or aspect, an arrival time and location targeting system can use wireless crossing activation as a safety overlay to existing track circuits. For example, the on-board computer (10) (and/or a remote processor or server, e.g., the back office server 23) can be programmed or configured to use the wireless crossing activation in place of the track circuit's corresponding approach circuit design speeds based on a location of the train (TR) in a current track or track network in which the train (TR) is traveling or a current user setting that enables or disables the wireless crossing activation. In another preferred and non-limiting embodiment or aspect, an arrival time and location targeting system can use wireless crossing application to eliminate the need for circuit-based crossing activation systems, which are expensive to install and maintain, and act as the primary means of activating crossings instead of the circuit-based crossing activation system, which reside on the track and not within the train (TR).

The on-board computer (10) (and/or a remote processor or server, e.g., the back office server 23) is programmed or configured to calculate and display the RTA and ETA, which can be updated in real-time on the visual display device 24. In some embodiments or aspects, the on-board computer (10) (and/or a remote processor or server, e.g., the back office server 23) may generate a graphical representation to represent a progress of the train (TR) toward the at least one target, e.g., a crossing, and provide guidance to an operator of the train. For example, a graphical progression bar that changes colors between green, yellow, orange and red could be used to indicate the train's proximity to the crossing and to display whether the train is on-time, e.g., ETA=RTA, or estimated to violate the RTA by being either early or late to the target.

An operator can compare the RTA against the ETA and modify the speed of the train (TR) based thereon, as long as the speed of the (TR) is not modified such that the train (TR) will arrive ahead of the calculated RTA. The operator can be guided by the difference between the two values. If the ETA is earlier (lower value) than the RTA, the operator can slow the train (TR) until the ETA matches or is larger than the RTA. The operator can accelerate the train (TR) if the ETA is much larger than the RTA.

Figure 4:
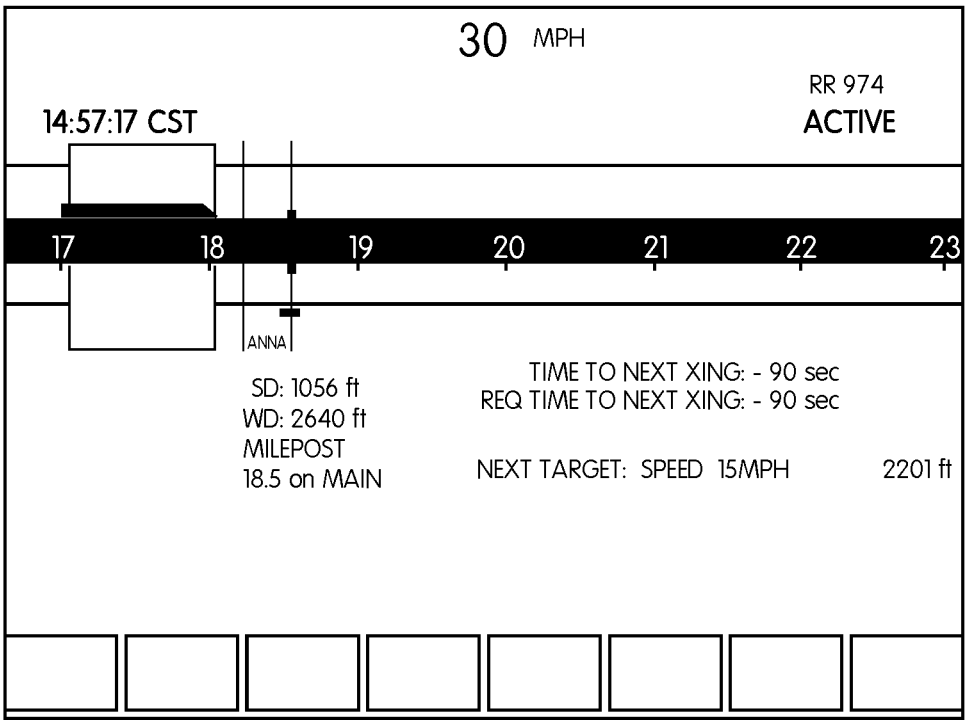
FIG. 4 is an example graphical representation of an operator interface of an arrival time and location targeting system according to principles of the present invention.

In one embodiment or aspect, the on-board computer (10) (and/or a remote processor or server, e.g., the back office server 23) can provide a graphical representation to indicate the train's progress toward the stop target, e.g., a crossing. For example, as shown in FIG. 4 a graphical representation of the train (TR), the crossing, and the distance therebetween can be provided on the visual display device (24). ETA is represented as "TIME TO NEXT XING" and RTA is represented as "REQ TIME TO NEXT XING" in the graphical representation of FIG. 4.

Figure 5:
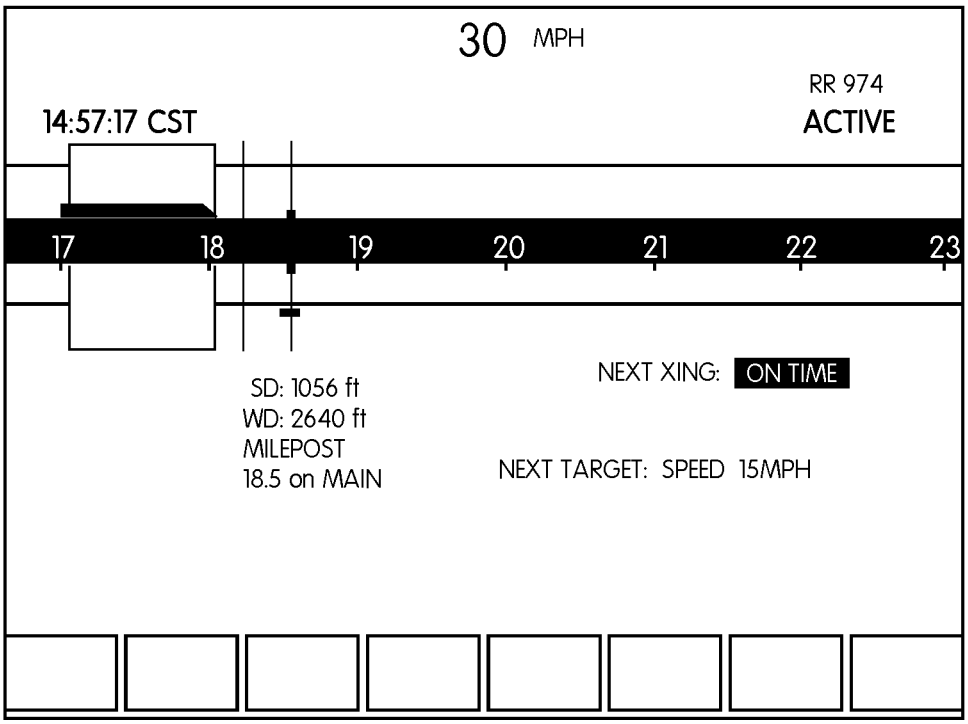
FIG. 5 is an example graphical representation of an operator interface of an arrival time and location targeting system according to principles of the present invention.

In another embodiment or aspect, the on-board computer (10) (and/or a remote processor or server, e.g., the back office server 23) can provide a display of a graphic that indicates the progress towards the crossing. For example, a green background to the right of the "NEXT XING" label as shown in FIG. 5 can indicate that the train is estimated to arrive at a time that allows adequate expiration of the minimum allowable crossing time.

Figure 6A:
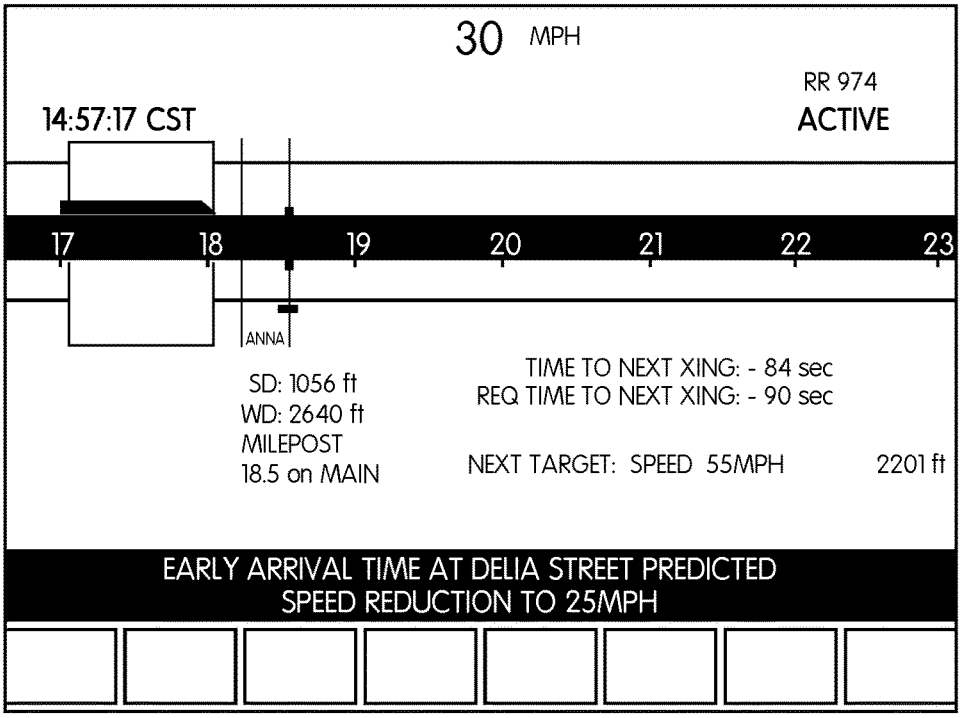
FIG. 6A is an example graphical representation of an operator interface of an arrival time and location targeting system according to principles of the present invention.
Figure 6B:
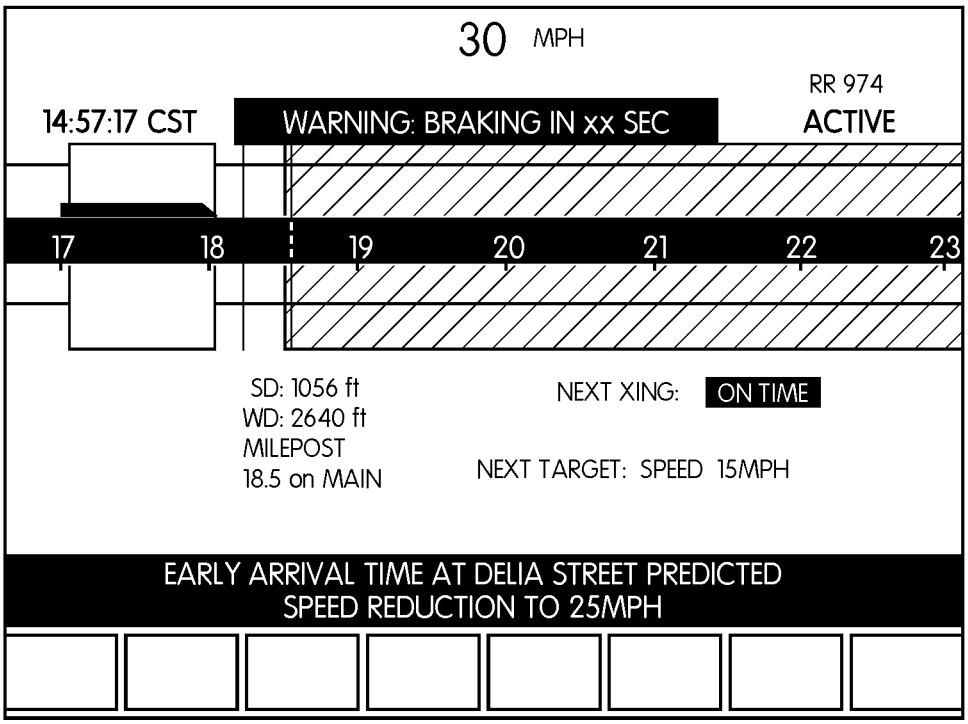
FIG. 6B is an example graphical representation of an operator interface of an arrival time and location targeting system according to principles of the present invention.
Figure 7A:
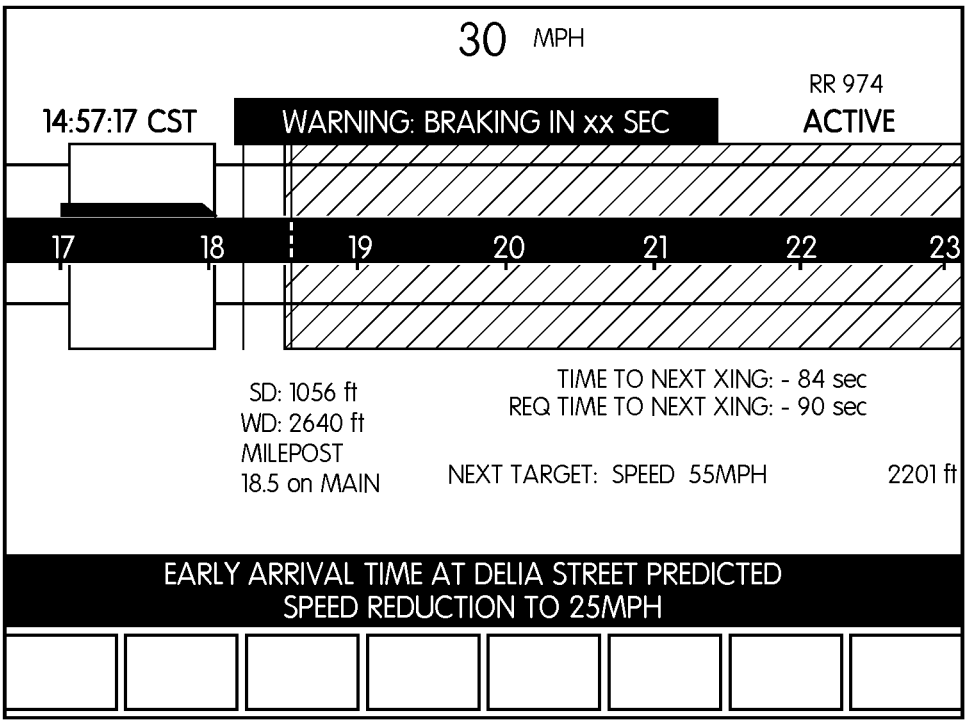
FIG. 7A is an example graphical representation of an operator interface of an arrival time and location targeting system according to principles of the present invention.
Figure 7B:
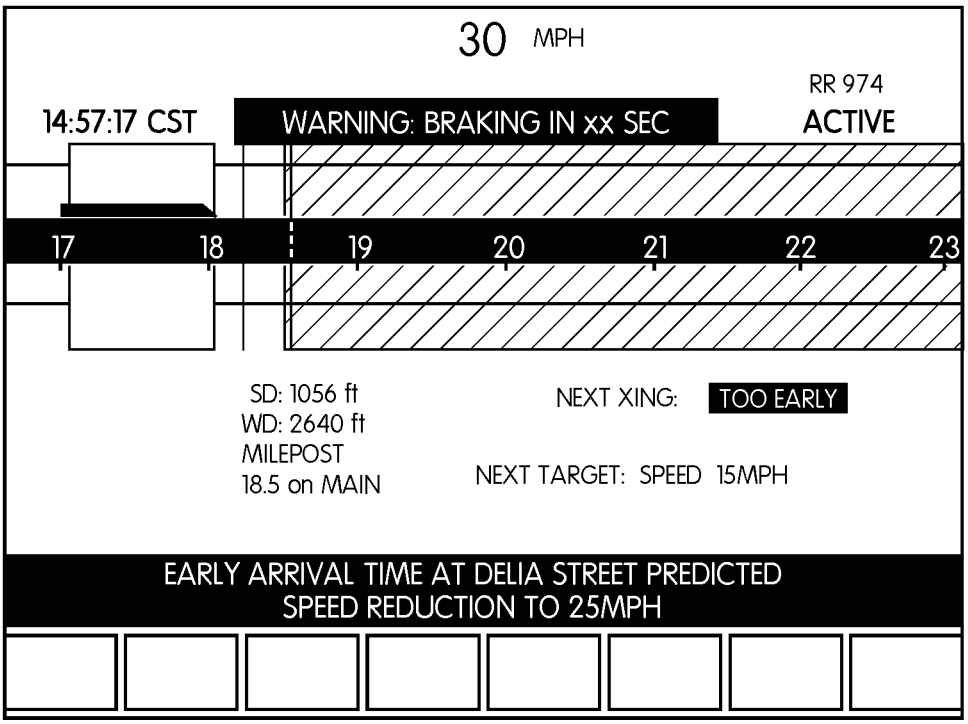
FIG. 7B is an example graphical representation of an operator interface of an arrival time and location targeting system according to principles of the present invention.

If the ETA is ahead of the RTA, a warning can be displayed as shown by the yellow banner graphic and text associated therewith in FIGS. 6A and 6B indicating an early arrival. The on-board computer (10) (and/or a remote processor or server, e.g., the back office server 23) can continuously calculate the target speed required to meet the RTA and display the continuously updated speed in the warning banner graphic. The operator can use the displayed speed as guidance on what speed the train (TR) should be travelling in order to prevent an automatic braking enforcement. Accordingly, the target speed of the train (TR) for wireless crossing activation is dynamic and changes based on variations to speed, time and distance from the crossing of the train (TR). As the train (TR) approaches the crossing, if the operator continues to allow the ETA of the train (TR) violate the RTA, the on-board computer (10) (and/or a remote processor or server, e.g., the back office server 23) begins a countdown to when a train stop is to be automatically enforced, i.e. the brakes applied. If the operator sufficiently adjusts the speed of the train (TR) based on the displayed guidance before the countdown expires, the warning disappears. If the guidance is ignored, the warning timer countdown continues as shown in FIGS. 7A and 7B.

Figure 8A:
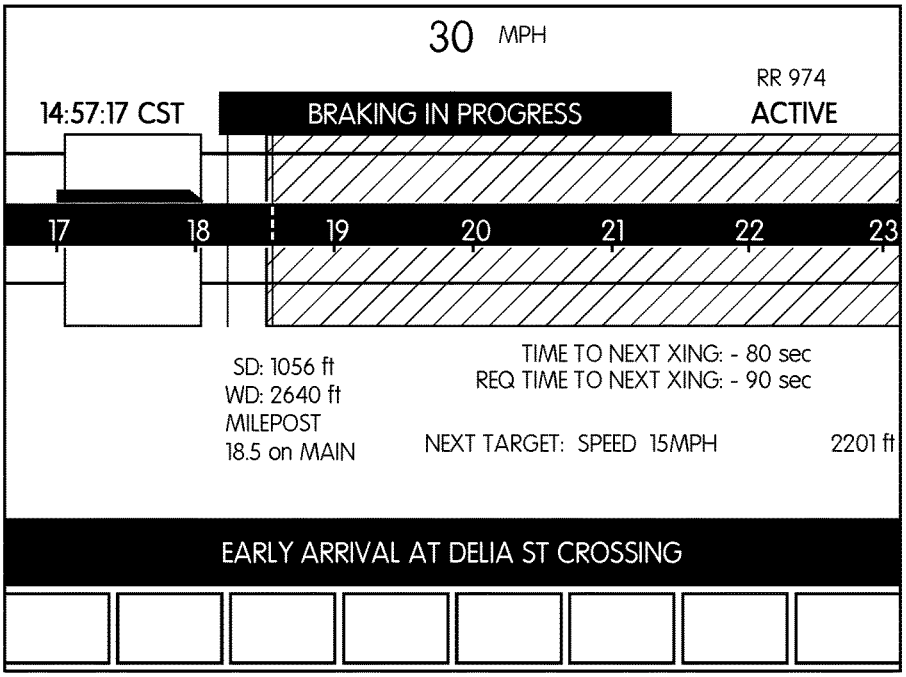
FIG. 8A is an example graphical representation of an operator interface of an arrival time and location targeting system according to principles of the present invention.
Figure 8B:
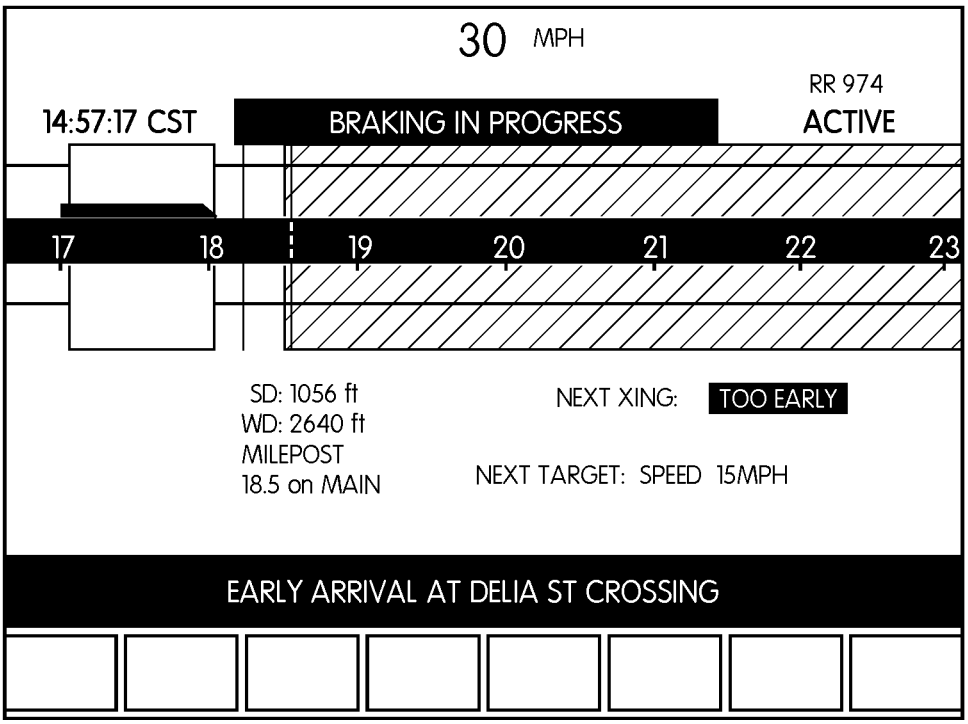
FIG. 8B is an example graphical representation of an operator interface of an arrival time and location targeting system according to principles of the present invention.

After a warning timer expires, the PTC targeting and braking process/methodology of the on-board computer (10) (and/or a remote processor or server, e.g., the back office server 23) takes over and forces the train to stop. As shown in FIGS. 8 and 8B, the on-board computer (10) (and/or a remote processor or server, e.g., the back office server 23) can provide a display including the name of the crossing (represented in the red banner) for which the train (TR) is violating the minimum allowable crossing time and an indicating that automatic breaking has been implemented.

Figure 9A:
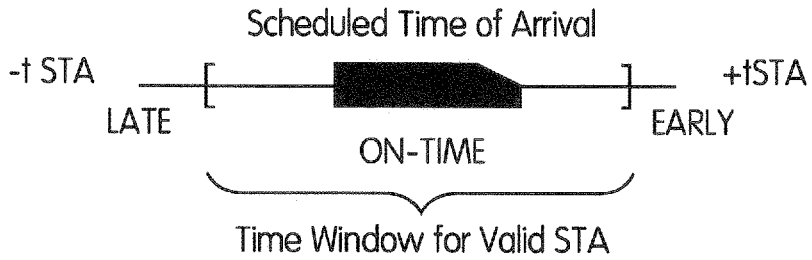
FIG. 9A is an example graphical representation of an operator interface of an arrival time and location targeting system according to principles of the present invention.
Figure 9B:
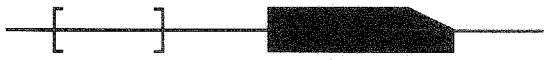
FIG. 9B is an example graphical representation of an operator interface of an arrival time and location targeting system according to principles of the present invention.
Figure 9C:
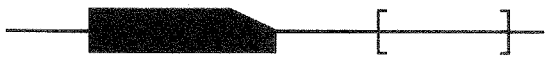
FIG. 9C is an example graphical representation of an operator interface of an arrival time and location targeting system according to principles of the present invention.

In another implementation, the on-board computer (10) (and/or a remote processor or server, e.g., the back office server 23) can provide a display of a graphic including the train (TR) and brackets as shown in FIG. 9A. The graphic, which can be referred to as a time-based speed cue, can represent the ETA versus the RTA based on the current position and speed of the train (TR) or locomotive (L). For example, the on-board computer (10) (and/or a remote processor or server, e.g., the back office server 23) can generate a display of the graphic on the visual display device (24) with the train (TR) is represented within the brackets in the graphic and/or in a green color if the train (TR) is currently on-time, e.g., ETA is substantially equal to RTA, as shown in FIG. 9A. If the train (TR) is currently going to arrive at the target location early, i.e., ETA is less than RTA, the on-board computer (10) can provide a display of the graphic with the train (TR) represented outside and to the right of the brackets and/or in a red color, as shown in FIG. 9B. If the train (TR) is currently going to arrive at the target location late, e.g., ETA is greater than RTA, the on-board computer (10) (and/or a remote processor or server, e.g., the back office server 23) can provide a display of the graphic with the train (TR) represented outside and to the left of the brackets and/or in a yellow color, as shown in FIG. 9C.

In one preferred and non-limiting embodiment or aspect, at least partially based upon the difference between the determined required time of arrival and the determined estimated time of arrival, the current speed of the train (TR), and/or the current location of the leading edge of the train, the on-board computer (10) (and/or a remote processor or server, e.g., the back office server 23) is programmed or configured to communicate or cause the communication of specified data to at least one of the following: a remote server, a wayside device, a device associated with a crossing, a signal device, a cellular device, a specified entity, or any combination thereof. For example, wireless crossing activation allows for the track circuits to be inhibited while the train occupies the track circuits. Referring again to FIG. 3, the inhibit function wraps out the approach circuit (AC), therefore, preventing the crossing from activating even though the train is occupying the approach circuit (AC). A wireless communication session is established in advance of the approach circuit (AC) by repeatedly sending a crossing inhibit request message. The on-board computer (10) (and/or a remote processor or server, e.g., the back office server 23) can determine a time to end the inhibit message cycle and activate the crossing, by sending a crossing station release request message, at least partially based upon the difference between the determined required time of arrival and the determined estimated time of arrival, the current speed of the train (TR), and/or the current location of the leading edge of the train (TR). After the inhibit release message has been sent, the onboard computer (10) can establish a time based target at the crossing based on the ETA.

In this manner, provided is an improved arrival time and location targeting system and method.

Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A system comprising:

one or more processors configured to receive at least one target location associated with a forward route of a vehicle system, receive a required time of arrival at the at least one target location, and determine an estimated time of arrival of the vehicle system at the at least one target location based at least partially on a current location of the vehicle system and a current speed of the vehicle system, the one or more processors also configured to determine a time difference between the required time of arrival and the estimated time of arrival and to provide a warning including a countdown to when a braking enforcement action is to be automatically enforced at least partially based on the time difference that is determined, the one or more processors configured to determine whether the warning is ignored and implement or cause an automatic implementation of the braking enforcement action that causes the vehicle system to stop responsive to determining that the warning was ignored and the countdown expired.

2. The system of claim 1, wherein the one or more processors are configured to repeatedly receive the at least one target location, receive the required time of arrival, determine the estimated time of arrival, and determine the time difference based on at least one of: the current speed of the vehicle system, the current location of the vehicle system, a current location of a leading edge of the vehicle system, at least one braking prediction process, a set interval, or any combination thereof.

3. The system of claim 1, wherein the one or more processors are configured to automatically implement the braking enforcement action at least partially based upon the current speed of the vehicle system.

4. The system of claim 1, wherein the one or more processors are configured to automatically implement the braking enforcement action at least partially based upon a current location of a leading edge of the vehicle system.

5. The system of claim 1, wherein the required time of arrival is later than the estimated time of arrival.

6. The system of claim 1, wherein the one or more processors are configured to direct a visual display device onboard the vehicle system to display one or more of: the estimated time of arrival, the required time of arrival, the current speed of the vehicle system, a target speed of the vehicle system, the at least one target location, a current location of a leading edge of the vehicle system, braking data, alarm data, vehicle system data, route data, target location data, or any combination thereof.

7. The system of claim 1, wherein the at least one target location is associated with one or more of a crossing, a safety target, a route section, a route location, a specified location, a restricted speed location, a circuit, a restricted noise location, or any combination thereof.

8. The system of claim 1, wherein the one or more processors are configured to communicate or cause communication of specified data to one or more of an on-board computer, a remote server, a wayside device, a device associated with a crossing, a signal device, a cellular device, a specified entity, or any combination thereof at least partially based on the time difference that is determined.

9. The system of claim 1, wherein the one or more processors are configured to communicate or cause communication of specified data to one or more of a remote server, a wayside device, a device associated with a crossing, a signal device, a cellular device, a specified entity, or any combination thereof at least partially based on the current speed of the vehicle system.

10. The system of claim 1, wherein the one or more processors are configured to communicate or cause communication of specified data to one or more of an on-board computer, a remote server, a wayside device, a device associated with a crossing, a signal device, a cellular device, a specified entity, or any combination thereof at least partially based on the current location of the vehicle system.

11. The system of claim 1, wherein the one or more processors are configured to access at least one database that stores the at least one target location.

12. The system of claim 11, wherein the at least one database comprises a track database in a positive train control system.

13. The system of claim 1, wherein the one or more processors are configured to determine a target speed of the vehicle system based on the time difference between the required time of arrival and the estimated time of arrival, determine a required acceleration or deceleration time associated with adjusting the current speed of the vehicle system to match the target speed of the vehicle system, and implement or cause implementation of the braking enforcement action that causes the vehicle system to stop based on the time difference between the required acceleration or deceleration time and the required time of arrival.

14. The system of claim 13, wherein the one or more processors are configured to implement or cause the implementation of the braking enforcement action before the speed adjustment time is later than the required time of arrival.

15. A method comprising:

receiving at least one target location associated with a forward route of a vehicle system;

receiving a required time of arrival at the at least one target location;

determining an estimated time of arrival of the vehicle system at the at least one target location based at least partially on a current location of the vehicle system and a current speed of the vehicle system;

determining a time difference between the required time of arrival and the estimated time of arrival;

providing a warning including a countdown to when a braking enforcement action is to be automatically enforced at least partially based on the time difference that is determined; and implementing or causing automatic implementation of the braking enforcement action that causes the vehicle system to stop responsive to determining that the warning was ignored and the countdown expired.

16. An apparatus comprising at least one non-transitory computer-readable medium having program instructions stored thereon that, when executed by at least one processor, cause the at least one processor to:

receive at least one target location associated with a forward route of a vehicle system;

receive a required time of arrival at the at least one target location;

determine an estimated time of arrival of the vehicle system at the at least one target location based at least partially on a current location of the vehicle system and a current speed of the vehicle system;

determine a time difference between the required time of arrival and the estimated time of arrival;

provide a warning including a countdown to when a braking enforcement action is to be automatically enforced at least partially based on the time difference that is determined; and implement or cause automatic implementation of a braking enforcement action that causes the vehicle system to stop in response to determining that the warning is ignored and the countdown expired.

* * * * *